US011771284B2

(12) United States Patent
Pruiett et al.

(10) Patent No.: US 11,771,284 B2
(45) **Date of Patent: *Oct. 3, 2023**

(54) FLOOR CLEANING APPARATUS WITH CLEANING FLUID DELIVERY SYSTEM

(71) Applicant: BISSELL Inc., Grand Rapids, MI (US)

(72) Inventors: Jason W. Pruiett, Grand Rapids, MI (US); Jacob Resch, Rockford, MI (US); James Theodore Hotary, Holland, MI (US); Guoshun Wang, Shenzhen (CN)

(73) Assignee: BISSELL Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/583,325

(22) Filed: Jan. 25, 2022

(65) Prior Publication Data

US 2022/0142442 A1 May 12, 2022

Related U.S. Application Data

(63) Continuation of application No. 17/114,656, filed on Dec. 8, 2020, now Pat. No. 11,266,285.
(Continued)

(51) Int. Cl.

| | |
|---|---|
| ***A47L 11/26*** | (2006.01) |
| ***A47L 11/30*** | (2006.01) |
| ***A47L 11/40*** | (2006.01) |

(52) U.S. Cl.

CPC ..... *A47L 11/26* (2013.01); *A47L 11/302* (2013.01); *A47L 11/4016* (2013.01); *A47L 11/4041* (2013.01); *A47L 11/4044* (2013.01); *A47L 11/4075* (2013.01); *A47L 11/4086* (2013.01); *A47L 11/4091* (2013.01)

(58) Field of Classification Search

CPC ..... A47L 11/34; A47L 5/362; A47L 5/365; A47L 7/0023; A47L 7/0042; A47L 9/0027; A47L 9/0036; A47L 9/0045; A47L 11/4002; A47L 11/4008; A47L 11/4016; A47L 11/4019; A47L 11/4025; A47L 11/4027; A47L 11/4075; A47L 11/4083; A47L 11/4088; A47L 7/0019; A47L 9/102; A47L 9/242

See application file for complete search history.

(56) References Cited

U.S. PATENT DOCUMENTS

| | | | |
|---|---|---|---|
| 4,167,799 | A | 9/1979 | Webb |
| 6,400,048 | B1 | 6/2002 | Nishimura et al. |

(Continued)

FOREIGN PATENT DOCUMENTS

| | | | |
|---|---|---|---|
| CN | 2540155 | Y | 3/2003 |
| CN | 201404160 | Y | 2/2010 |

(Continued)

*Primary Examiner* — David Redding

(74) *Attorney, Agent, or Firm* — WARNER NORCROSS + JUDD LLP

(57) ABSTRACT

The present disclosure provides a surface cleaning apparatus that includes a steam delivery system for steam mopping a floor surface after sweeping dry dirt, dust, hair, and other debris from the floor surface. The surface cleaning apparatus can be configured to perform multiple cleaning functions, including dry sweeping and steam mopping. The surface cleaning apparatus can have a steam vent for venting a portion of the steam from a brush chamber.

20 Claims, 28 Drawing Sheets

Related U.S. Application Data

(60) Provisional application No. 62/945,263, filed on Dec. 9, 2019.

(56) References Cited

U.S. PATENT DOCUMENTS

| | | | | |
|---|---|---|---|---|
| 8,458,850 | B2 | 6/2013 | Kasper et al. | |
| 11,266,285 | B2 * | 3/2022 | Pruiett | A47L 11/22 |
| 2007/0214586 | A1 | 9/2007 | Mattucci et al. | |
| 2010/0287716 | A1 | 11/2010 | Kasper et al. | |
| 2017/0231455 | A1 | 8/2017 | Krebs et al. | |
| 2017/0273523 | A1 | 9/2017 | Kasper et al. | |
| 2018/0213995 | A1 | 8/2018 | Krebs et al. | |
| 2018/0344112 | A1 | 12/2018 | Krebs et al. | |

FOREIGN PATENT DOCUMENTS

| | | | |
|---|---|---|---|
| CN | 105877623 | B | 12/2018 |
| WO | 2008096950 | A1 | 8/2008 |
| WO | 2012130123 | A1 | 10/2012 |

* cited by examiner

FLOOR CLEANING APPARATUS WITH CLEANING FLUID DELIVERY SYSTEM

CROSS-REFERENCE TO RELATED APPLICATION(S)

The present application is a continuation of U.S. patent application Ser. No. 17/114,656, filed Dec. 8, 2020, now U.S. Pat. No. 11,266,285, which claims the benefit of U.S. Provisional Application No. 62/945,263, filed Dec. 9, 2019, both of which are incorporated herein by reference in their entirety.

BACKGROUND

The common procedure of cleaning a bare floor surface, such as tile, linoleum, and hardwood floors, involves several steps and often requires multiple cleaning tools. First, dry or loose dirt is removed, and then liquid cleaning solution is applied to the surface either directly or by means of an agitator.

During the first step to remove dry dirt, a conventional broom and dustpan are often utilized. A user sweeps dirt into a pile and then transfers the pile to the dustpan for disposal. However, the broom and dustpan are not ideal for removing dry particles because it is difficult to transfer the entire dirt pile into the dustpan. Additionally, the user typically bends over to hold the dustpan in place while collecting the dirt pile. Such motion can be inconvenient, difficult, and even painful for some users. Dust cloths can also be used, but large dirt particles do not sufficiently adhere thereto. Another option is collecting the dry dirt using a vacuum cleaner or a sweeper (e.g. carpet sweepers). Each of these implements requires that a different cleaning tool be used during the second step to mop or wet-clean the floor.

The most common cleaning implement for mopping or wet-cleaning is a traditional sponge or rag mop. Mops are capable of loosening dirt from the floor and have excellent absorbency; however, when the mop requires more cleaning solution, it is placed in a bucket to soak up warm cleaning solution and returned to the floor. Each time more cleaning solution is required, the mop is usually placed in the same bucket, and after several repetitions the cleaning solution becomes dirty and cold. As a result, dirty cleaning solution is used to remove dirt from the bare surface. Furthermore, the mop head wears with use and must be replaced periodically. Textured cloths can be used as an agitator, but they also require regular replacement. Additionally, cloths are not as absorbent as mops and, therefore, can leave excessive soiled cleaning solution on the floor.

Some household cleaning devices have been developed to simplify the cleaning process by reducing the number of cleaning steps required and eliminating the need for multiple cleaning implements These devices alleviate some of the problems described above that are associated with the individual tools. Such cleaning devices are usually adapted for vacuuming or sweeping dry dirt and dust prior to application of cleaning solution, applying and agitating the cleaning solution, and, subsequently, vacuuming the soiled cleaning solution into a recovery tank, thereby leaving only a small amount of cleaning solution on the bare surface. Common agitators are rotating brushes, rotating mop cloths, and stationary or vibrating sponge mops. A good portion of multifunctional cleaning devices utilize an accessory that is attached to the cleaning device to convert between dry and wet cleaning modes. Other devices are capable of performing all functions without accessories, but have complex designs and features that can be difficult and confusing to operate, as well as being heavy and expensive. Further, upon completion of a cleaning task, the agitator is wet and dirty, and often does not adequately dry out between cleaning operations, thereby reducing cleaning efficacy of the device during a subsequent cleaning.

Another development in the cleaning of bare floors is the steam mop, which uses steam as the cleaning agent. Typical steam mops have a reservoir for storing water that is fluidly connected to a selectively engageable pump or valve. The pump or valve outlet is fluidly connected to a steam boiler with a heating element to heat the water. The steam boiler generates steam, which is directed towards the surface to be cleaned through a nozzle or manifold mounted in a foot assembly that engages the floor surface. Steam is typically applied to the backside of a cleaning pad attached to the foot assembly. Steam vapor eventually saturates the entire cleaning pad as the moisture wicks outwardly from the point of steam application. The damp pad is wiped across the floor surface to remove dirt present on the floor surface. However, steam mops still require two cleaning steps—namely, removing dry dirt followed by steam mopping.

BRIEF SUMMARY

A surface cleaning apparatus is provided herein. In certain embodiments, the surface cleaning apparatus can be a multifunction steam sweeper that can be used to clean hard floor surfaces such as tile and hardwood completely, by performing both dry sweeping and steam mopping.

According to one embodiment of the invention, a surface cleaning apparatus can include steam generator, a supply tank, and a base that is adapted to move along a surface to be cleaned. The base has a brush chamber, a brushroll in the brush chamber, a collection bin, and a steam distributor. At least one steam vent is provided in the base for venting a portion of the steam from the brush chamber.

In one embodiment, the steam delivery system can include a supply tank, optionally provided on the upright body, and is adapted to hold a quantity of water or other cleaning liquid, a steam generator for heating the water or other cleaning liquid from the supply tank to steam, and a steam distributor for applying the steam to the surface to be cleaned, optionally indirectly via the brushroll. The steam distributor can be located on the base and can be configured for dispensing steam onto the brushroll. Alternatively, the steam distributor can be configured to dispense steam directly onto the floor.

In some embodiments, the steam sweeper can be converted into different use configurations, including upright use and handheld use.

In one embodiment, the collection bin can be removable from the base. Optionally, the collection bin can be removed through a lateral side of the base for emptying. The collection bin can slide out of a housing of the base transversely to remove the collection bin from the base.

In one embodiment, the brushroll can be removable from the base. Optionally, a brushroll latch can secure the brushroll within a brush chamber on the base. The brushroll can be removed individually, or as a unit with the collection bin.

In one embodiment, the brushroll can be a hybrid brushroll that includes multiple agitation materials to optimize cleaning performance for different cleaning modes, including steam mopping and dry sweeping.

In one embodiment, the base can comprise a brush chamber and the brushroll rotates within the brush chamber and positively pressurizes the brush chamber. At least one relief vent is provided in the base housing for relieving the positive pressure in the brush chamber.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF EMBODIMENTS OF THE INVENTION

The invention generally relates to a surface cleaning apparatus, which may be in the form of a sweeper having a steam delivery system.

The functional systems of the surface cleaning apparatus or steam sweeper can be arranged into any desired configuration, such as an upright device having a base and an upright body for directing the base across the surface to be cleaned. Other optional configurations include a portable device adapted to be hand carried by a user for cleaning relatively small areas or an autonomous cleaner adapted to move without the assistance of a user or operator to clean a floor surface. As used herein, the term "steam sweeper" or "multi-function steam sweeper" includes a sweeper that can be used to clean hard floor surfaces, such as tile and hardwood, completely, by performing both dry sweeping and steam mopping.

While primarily discussed herein in terms of a steam sweeper, the features of the surface cleaning apparatus disclosed herein are applicable to other types of surface cleaning apparatus, including any surface cleaning apparatus having a cleaning fluid delivery system, such as apparatus having a suction source to create a partial vacuum to suck up dirt and liquid from floors and from other surfaces, i.e. a vacuum cleaner, extraction cleaner, or deep cleaner, a steam mop or wet mop, a steam cleaning apparatus without a sweeping function, a sweeper with a liquid delivery system, etc.

Figure 1:
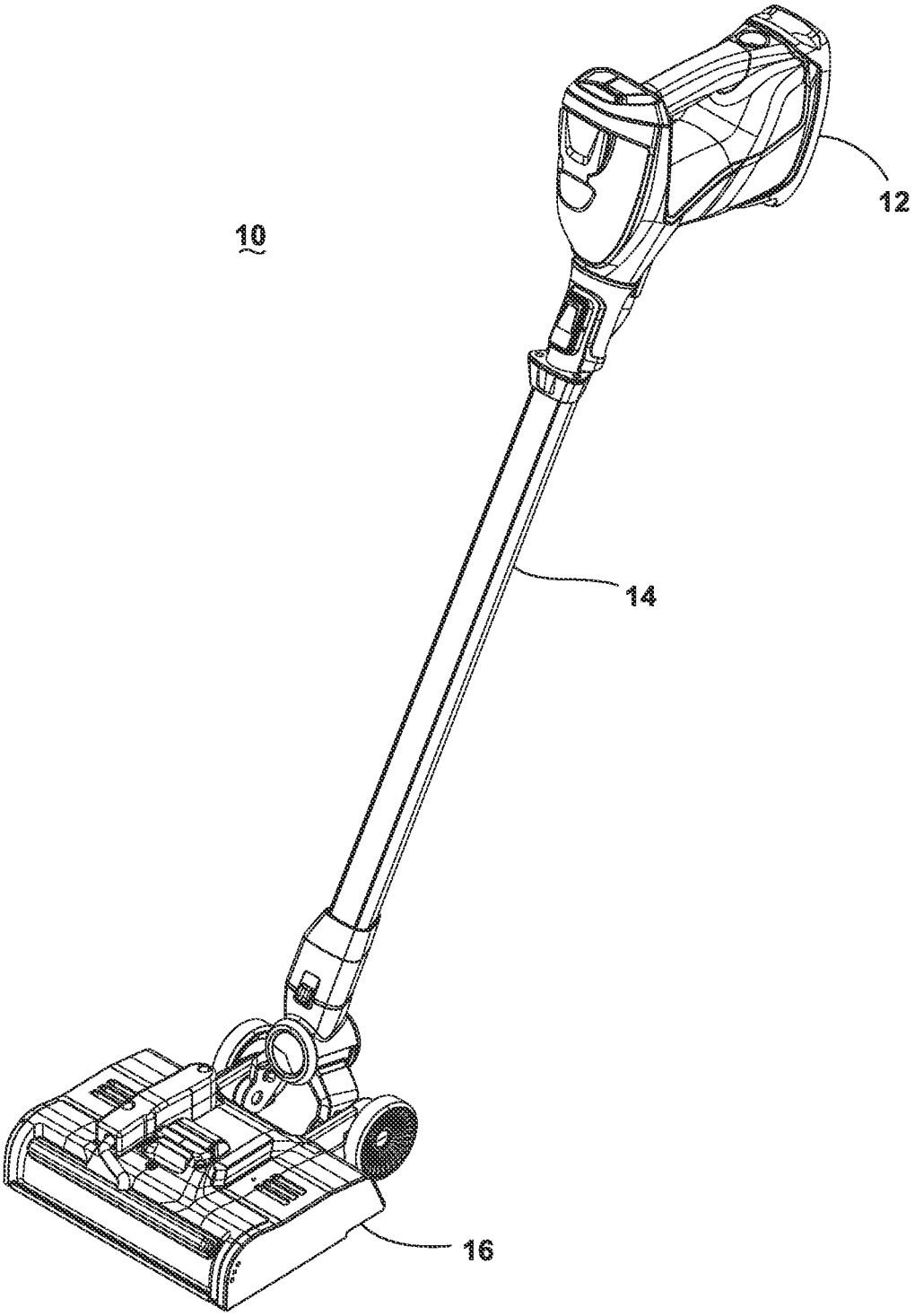
FIG. 1 is a perspective view of a surface cleaning apparatus in the form of a convertible steam sweeper according to one embodiment of the invention, with the steam sweeper in an upright or mopping mode of operation.

FIG. 1 is a perspective view of a surface cleaning apparatus or steam sweeper 10 according to one embodiment of the invention. The steam sweeper 10 is provided with various features and improvements, which are described in further detail below. The steam sweeper 10 of the illustrated embodiment may alternatively be referred to herein as a multi-function steam sweeper or simply a sweeper, and includes a steam unit 12, a detachable wand 14 and a cleaning foot or base 16 adapted to move over a surface to be cleaned. The steam sweeper 10 includes a steam delivery system and a collection system, which are described in further detail below, and which can include components supported on any of the steam unit 12, wand 14, or base 16. The steam sweeper 10 can sweep dry dirt and/or liquid from a surface to be cleaned by mechanically propelling dirt and/or liquid into a collection bin using a brushroll or other mechanical agitator. The steam sweeper 10 can generate and deliver steam to a surface to be cleaned, including floor surfaces, such as tile, linoleum, vinyl, laminate, and hardwood floors, and other hard surfaces such as tiles and countertops. The steam sweeper 10 can be convertible between different modes of operation to efficiently clean different surface types and hard-to-reach areas.

For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the steam sweeper 10, which defines the rear of the sweeper 10. However, it is to be understood that the disclosure may assume various alternative orientations, except where expressly specified to the contrary. The term "dirt" includes dirt, dust, hair, and other debris, unless otherwise noted. The term "steam" includes a liquid, such as but not limited to water or solutions containing water (like water mixed with a cleaning chemistry, fragrance, etc.), converted to a gas or vapor phase. The liquid can be boiled or otherwise converted to the gas or vapor phase by heating or mechanical action like nebulizing. The steam can be invisible to the naked eye, in the form of a visible mist formed when the gas or vapor condenses in air, or combinations thereof.

Figure 2:
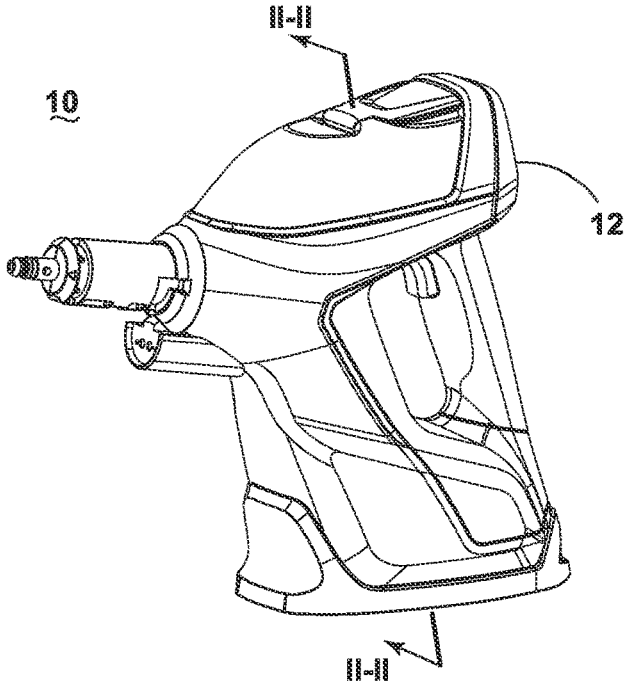
FIG. 2 is a perspective view of the surface cleaning apparatus of FIG. 1 in a handheld mode of operation.

The steam unit 12 can comprise a modular, handheld steam unit 12 that can be used independently of the wand 14 and base 16 to clean a surface. Thus, the wand 14 and base 16 are removable or detachable from the steam unit 12. The steam sweeper 10 is convertible between at least two different modes of operation, including an upright or mopping mode of operation shown in FIG. 1, in which the wand 14 and base 16 are attached to the steam unit 12, and a handheld mode of operation shown in FIG. 2, in which the wand 14 and base 16 are detached from the steam unit 12. The upright or mopping mode may be useful for cleaning floor surfaces, such as tile, linoleum, vinyl, laminate, and hardwood floors, while the handheld mode may be useful for cleaning other hard surfaces such as tiles and countertops.

Figure 3:
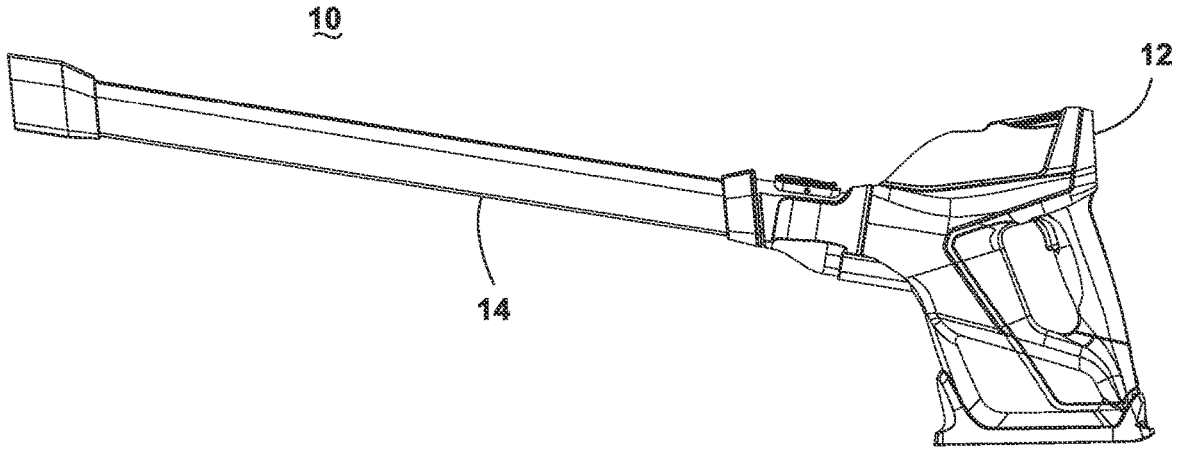
FIG. 3 is a perspective view of the surface cleaning apparatus of FIG. 1 in a remote cleaning mode of operation.
Figure 4:
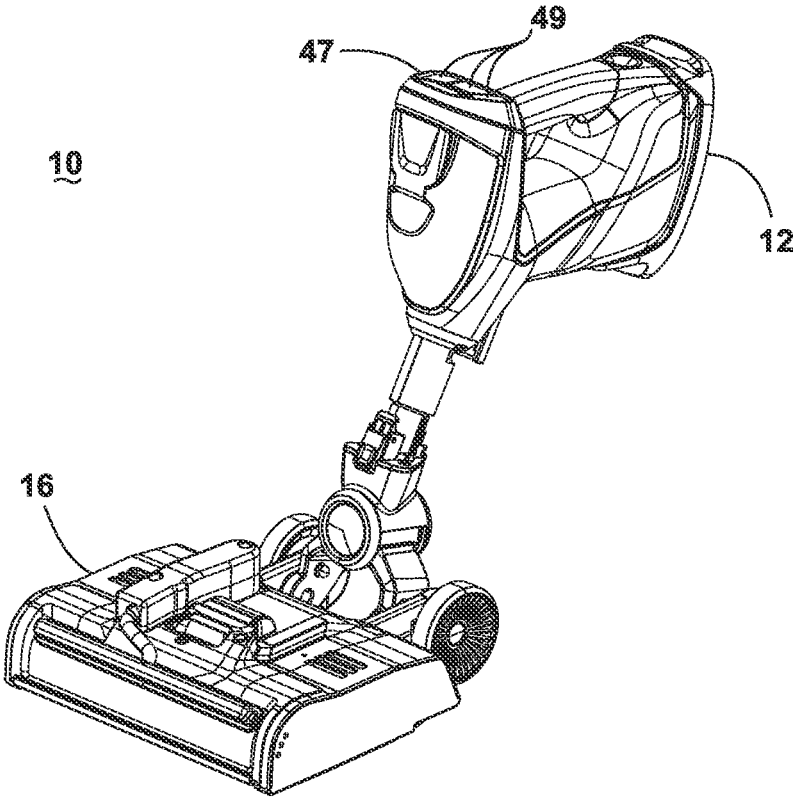
FIG. 4 is a perspective view of the surface cleaning apparatus of FIG. 1 in a handheld accessory mode of operation.

The steam sweeper 10 can further be provided with other modes of operation, such as a remote cleaning mode of operation, shown in FIG. 3, in which the wand 14 is attached to the steam unit 12 and the base 16 is removed, which allows the steam sweeper 10 to steam clean remote or hard to reach areas. Another mode of operation is a handheld accessory mode of operation, one example of which is shown in FIG. 4, in which the wand 14 is detached from the steam unit 12, and a cleaning accessory tool is attached in its place. For example, the base 16 itself can be directly attached to the steam unit 12. Other accessory tools (not shown) can be used in the handheld accessory mode instead of the base 16.

Figure 5:
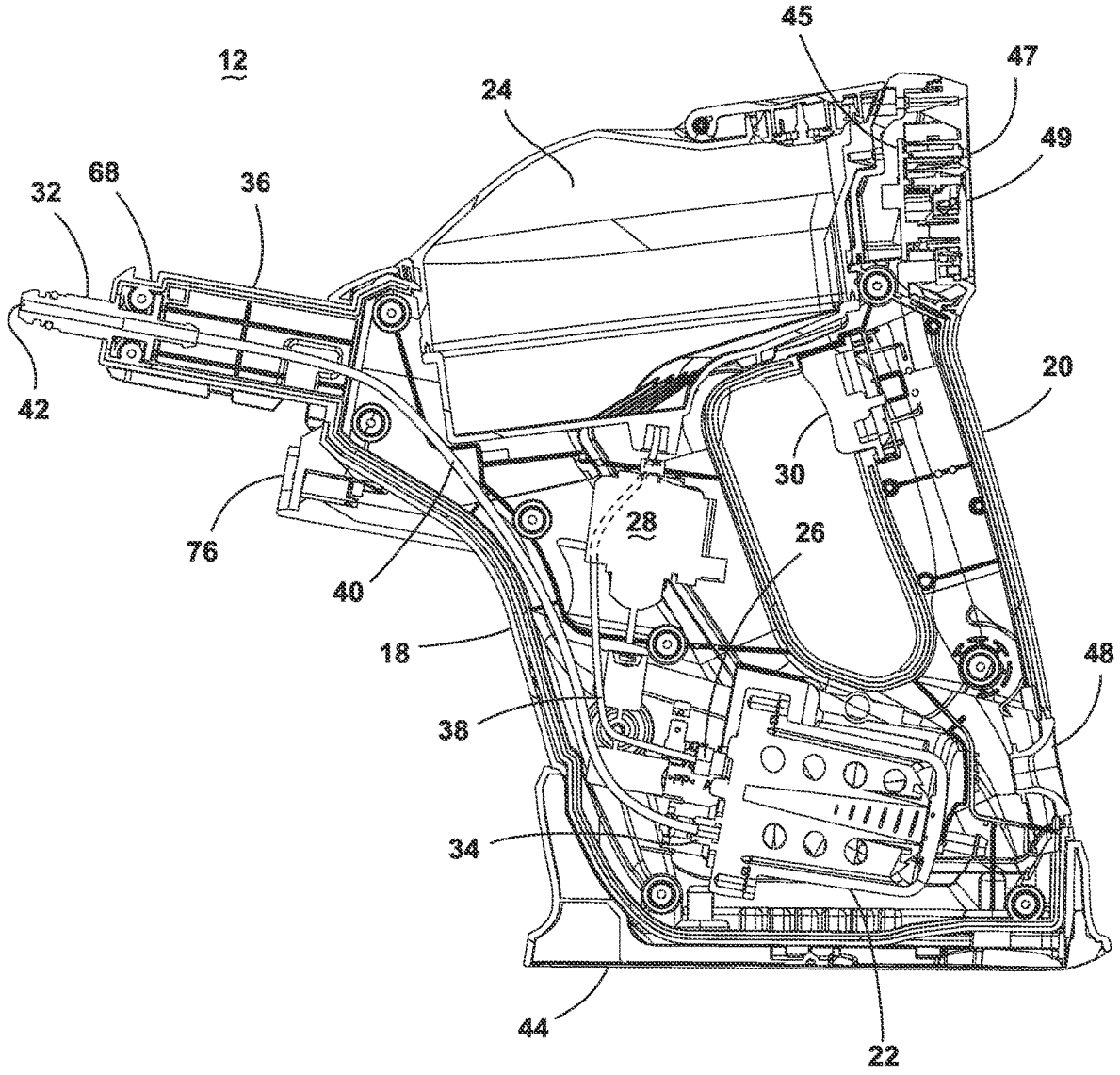
FIG. 5 is a cross-sectional view through line II-II of FIG. 2, showing a steam unit of the surface cleaning apparatus.

FIG. 5 is a cross-sectional view through the steam unit 12. The steam unit 12 can comprise a housing 18 with a pistol-style grip 20 and which carries a steam delivery system for generating steam and delivering the steam to a surface to be cleaned. The steam delivery system can include a steam generator 22 in the form of a heater for heating liquid to at least 100° C. to generate steam, a supply tank 24 in fluid communication with an inlet 26 of the steam generator 22, a pump 28 which pressurizes the delivery system to supply liquid from the tank 24 to the steam generator 22, an actuator 30 for the pump 28 to deliver liquid on demand to the steam generator 22, and a steam distribution nozzle 32 in fluid communication with an outlet 34 of the steam generator 22 for delivering steam to a surface to be cleaned directly, or indirectly via the wand 14, base 16, or another cleaning tool. The actuator 30 can comprise a trigger or button mounted to the pistol-style grip 20, and can control fluid delivery from the supply tank 24 to the steam generator 22 via an electronic or mechanical coupling with the pump 28.

The supply tank 24 stores cleaning liquid, and can be removable from the housing 18 for refilling the tank 24 with liquid, or can be refilled when on the housing 18. The cleaning fluid can comprise one or more of any suitable cleaning fluids, including, but not limited to, water, mixtures containing water, concentrated detergent, diluted detergent, etc., and mixtures thereof. For example, the fluid can comprise a mixture of water and concentrated detergent.

The steam distribution nozzle 32 can be provided on a steam outlet conduit 36 protruding from the steam unit housing 18. The steam outlet conduit 36 can further mount various attachments, including the wand 14 and/or the base 16. Flexible tubing or other suitable fluid conduits 38, 40 can connect pump 28 with the steam generator inlet 26 and the steam generator outlet 34 with the steam distribution nozzle 32, respectively.

The steam distribution nozzle 32 can include at least one nozzle outlet 42 on the unit housing 18 for delivering steam to a surface to be cleaned. The steam distribution nozzle 32 can be in an opposing relationship to the pistol grip 20, with the steam distribution nozzle 32 on a forward end of the unit housing 18 and the pistol grip 20 a rearward end of the unit housing 18. A bottom 44 of the unit housing 18 can define a substantially flat surface on which the unit 12 can rest in an upright position.

The steam sweeper 10 can further include a controller 45 operably coupled with the various function systems of the steam sweeper 10 for controlling its operation such as being operably coupled with the steam generator 22 and/or pump 28. The controller 45 can be provided at various locations on the steam sweeper 10, and in the illustrated embodiment is located in the steam unit 12, within the housing 18. The controller 45 can be a microcontroller unit (MCU) that contains at least one central processing unit (CPU).

Referring to FIGS. 4 and 5, the controller 45 can be electronically coupled with a user interface 47 through which a user can interact with the steam sweeper 10. The user interface 47 can be provided at various locations on the steam sweeper 10, and in the illustrated embodiment is located in the steam unit 12, above the grip 20. The user interface 47 can enable operation and control of the steam sweeper 10 from the user's end, and can also provide feedback information from the steam sweeper 10 to the user. The user interface 47 can be electrically coupled with electrical components, including, but not limited to, circuitry electrically connected to various components of the fluid delivery and collection systems of the steam sweeper 10, as described in further detail below. The user interface 47 can comprise one or more input controls 49, such as but not limited to buttons, triggers, toggles, keys, switches, or the like, operably connected to systems in the steam sweeper 10 to affect and control its operation. The user interface 47 can also communicate a condition or status of the steam sweeper 10 to the user.

Figure 6:
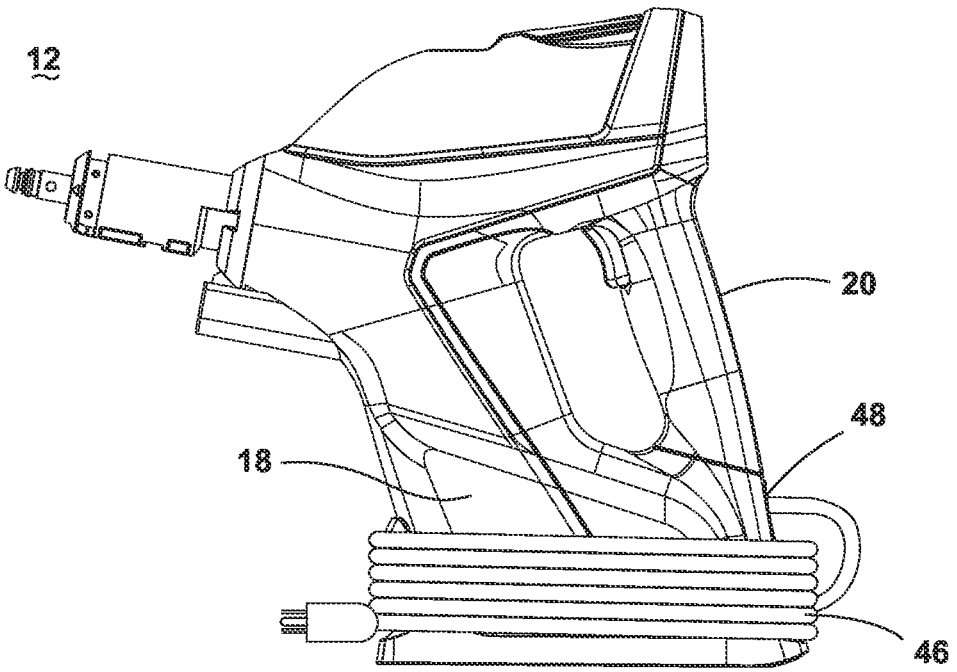
FIG. 6 is a side view of the steam unit from FIG. 5, showing a power cord wrapped around a housing of the steam unit for storage.

Referring to FIG. 6, a power cord 46 emerges from the interior of the housing 18 through a cord aperture 48, and can be used to provide power to electrical components of the steam unit 12 from a source of power, such as a home power supply, upon actuation of the actuator 30. The power cord 46 can also be used to provide power to other electrical components of the steam sweeper 10, such as any electrical components of the wand 14 or base 16, when coupled with the steam unit 12 in one of the other configurations shown in FIGS. 1-4. Alternatively, the electrical components of the steam sweeper 10 can be powered by a portable power supply, such as a battery. The power cord 46 can be wrapped around a lower portion of the housing 18, below the grip 20, for storage.

Figure 7:
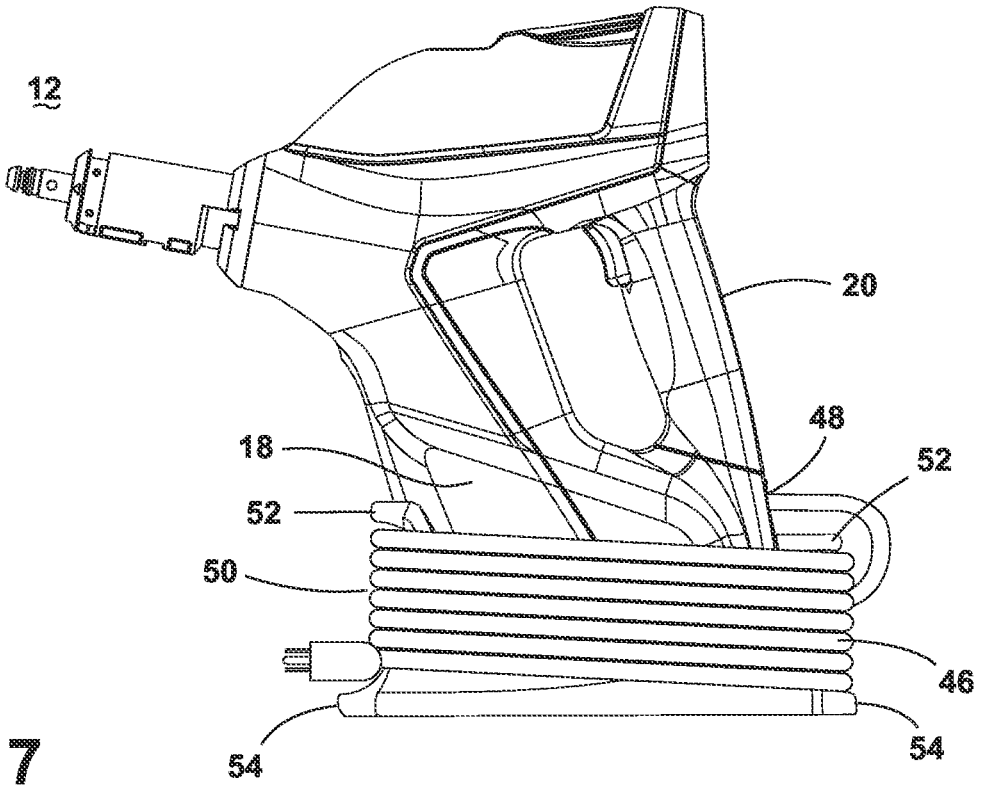
FIG. 7 is a side view of another embodiment of the steam unit of the surface cleaning apparatus, showing a power cord wrapped around a housing of the steam unit for storage.
Figure 8:
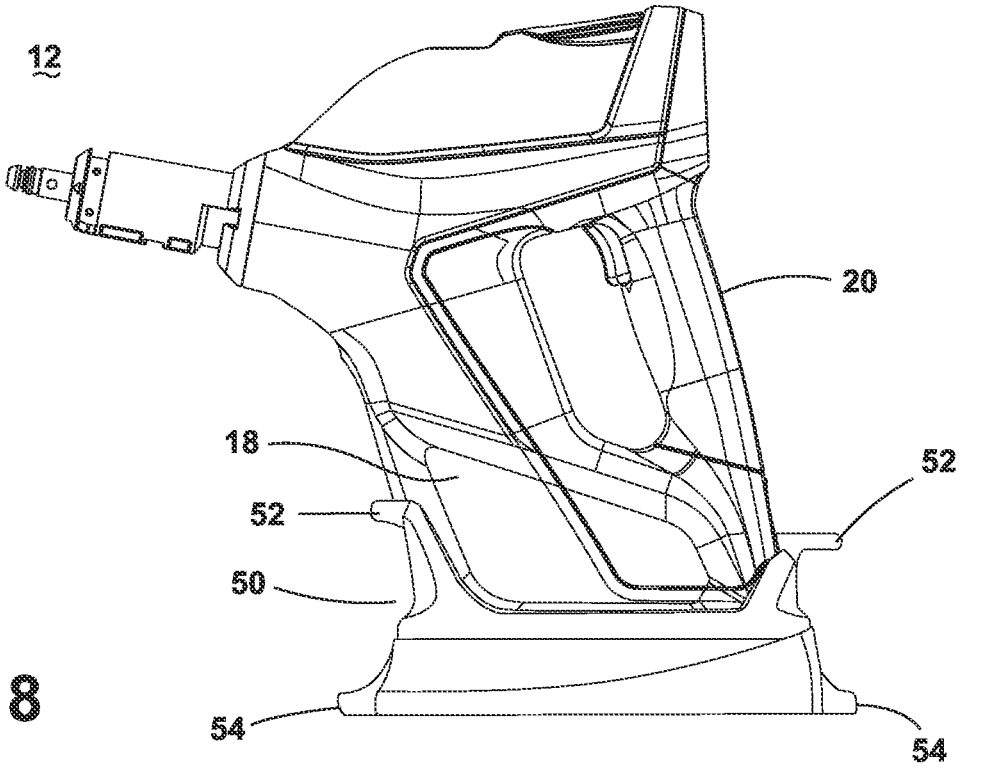
FIG. 8 is a side view of the steam unit from FIG. 7, with the power cord removed for clarity.

FIGS. 7-8 show an alternative embodiment of the steam unit 12, where the steam unit 12 includes a cord wrap groove 50 around a lower portion of the housing 18 for storing the power cord 46 on the housing 18. The groove 50 can be defined by upper and lower cord retainers 52, 54, projecting outwardly from the housing 18. The power cord 46 can be wrapped around the housing 18 and retained between the cord retainers 52, 54 below the grip 20. The cord wrap groove 50 can provide better control of the position of the wrapped power cord 46, and also provide a more obvious cord wrap location that visually informs the user where the power cord 46 can be stored.

Figure 9:
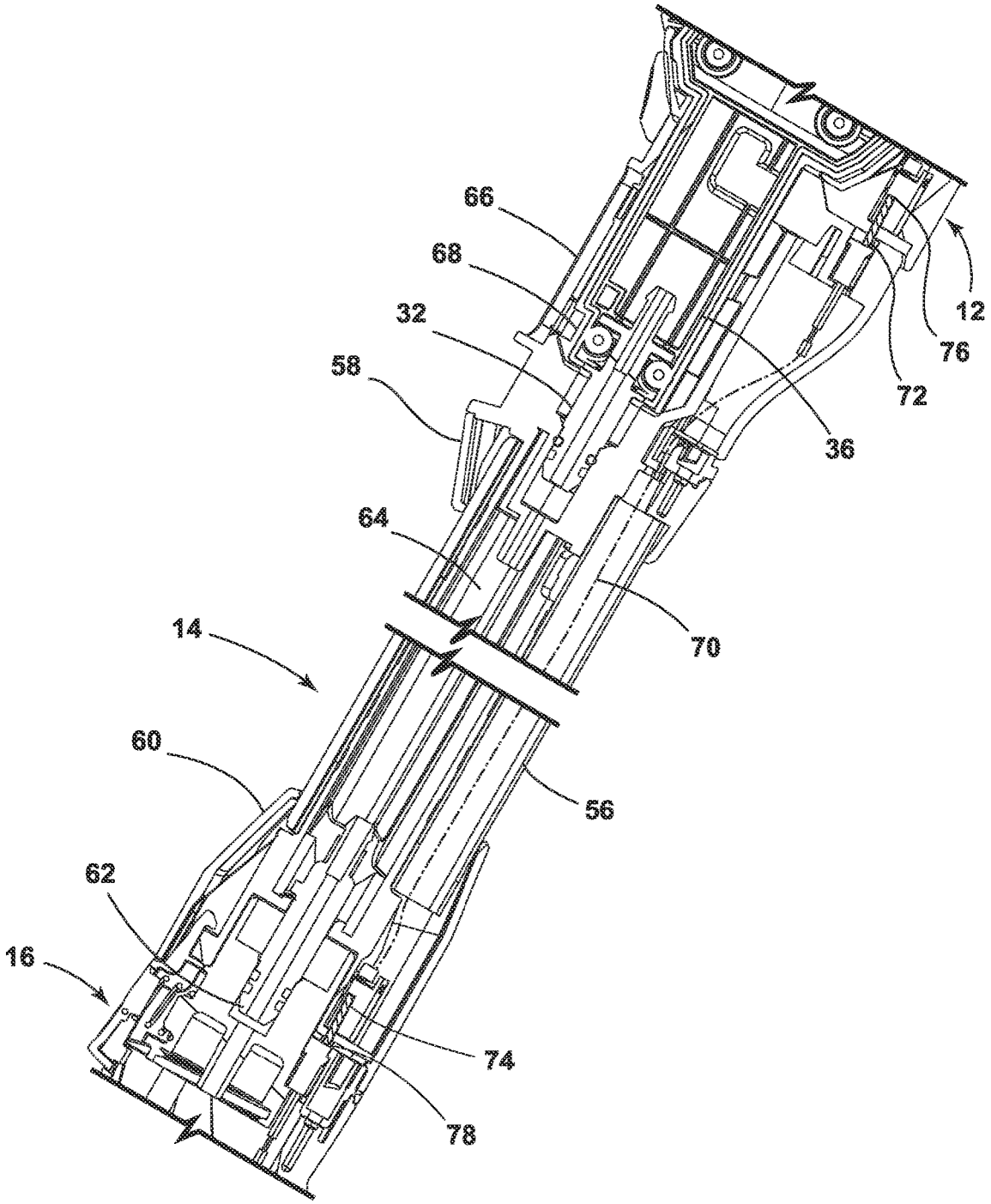
FIG. 9 is a partial sectional view through the wand of the surface cleaning apparatus of FIG. 1.

Referring to FIG. 9, the wand 14 can comprise an elongate tubular wand housing 56 with a first proximal end 58 adapted to be attached to the steam unit 12 and a second distal end 60 adapted to be attached to the base 16. The second end 60 can further comprise a steam distribution nozzle or wand nozzle 62 that is in fluid communication with a steam conduit 64 extending through the wand housing 56 to the first end 58. Coupling the wand 14 with the steam unit 12 places the steam conduit 64 in fluid communication with the steam delivery system, with the steam unit nozzle 32 supplying steam to the steam conduit 64, which in turn provides the steam to the wand nozzle 62. Optionally, the steam conduit 64 can comprise a cylindrical cross-sectional shape, while the wand housing 56 has a triangular cross-sectional shape.

A releasable latch for mounting the wand 14 to the steam unit 12 is provided, and may include a button 66 carried by the wand 14 which engages a detent 68 provided on the outlet conduit 36 of the steam unit 12. Alternatively, the button 66 can be carried by the steam unit 12, with the detent 68 provided in the wand 14.

The wand 14 can include one or more electrical conductors 70, for example insulated wires or cables, to transmit power and/or data signals between the steam unit 12 and the base 16. A first electrical connector 72 can be provided at the first end 58 for establishing an electrical connection with the steam unit 12 and a second electrical connector 74 can be provided on the second end 60 for establishing an electrical connection with the base 16, with the one or more electrical conductors 70 running between the electrical connectors 72, 74 within the wand housing 56. In one example, the electrical connectors 72, 74 can be one member of a pin-and-socket or male-and-female connection. In the illustrated embodiment, the first electrical connector 72 can comprise a pin or male connector, with a socket or female connector 76 provided on the steam unit 12. The second electrical connector 74 can comprise a socket or female connector, with a pin or male connector 78 provided on the base 16. With the wand 14 and base 16 attached to the steam unit 12 as shown in FIG. 9, electrical power can be provided to one or more electrical components within the base 16, and signals can be transmitted between the unit 12 and base 16.

Referring to FIGS. 1 and 3, the wand 14 can be used with the steam unit 12 to deliver steam with or without the base 16. In the upright mode, shown in FIG. 1, the steam unit 12/wand 14 assembly is pivotally connected to the base 16 for directing the base 16 across the surface to be cleaned. The pistol grip 20 on the steam unit 12 can be used for maneuvering the steam sweeper 10 over a surface to be cleaned. When connected between the steam unit 12 and the base 16, the wand 14 defines a portion of the steam delivery pathway between the steam generator 22 in the steam unit 12 and the base 16. When used without the base 16, as shown in FIG. 3, the steam sweeper 10 can deliver steam to the surface from the wand nozzle 62.

Figure 10:
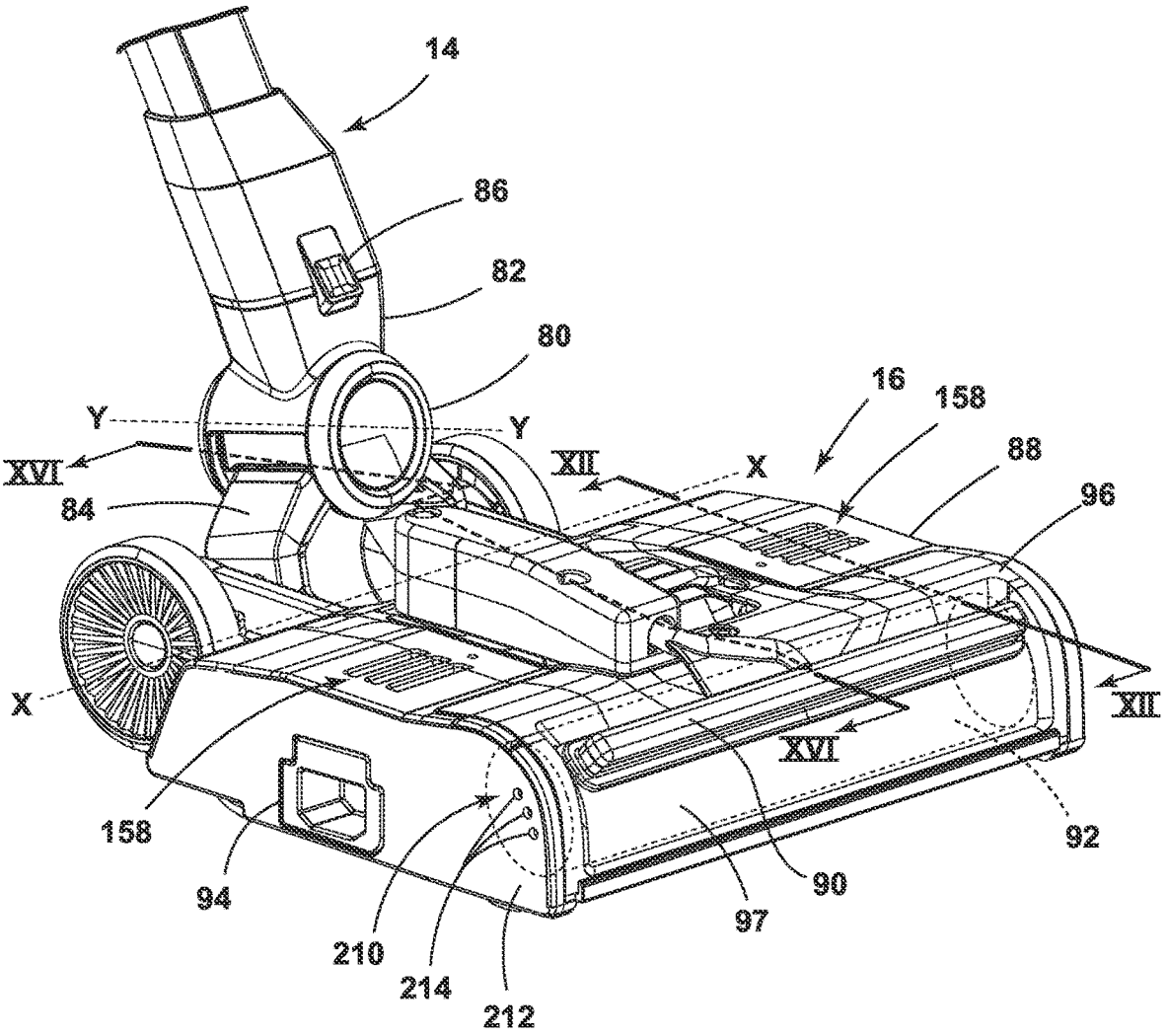
FIG. 10 is a perspective view of a lower portion of the surface cleaning apparatus of FIG. 1, showing a cleaning foot or base of the surface cleaning apparatus.

Referring to FIG. 10, in the embodiment shown, the base 16 can be pivotally attached to the wand 14, or alternatively to the steam unit 12 as shown in FIG. 4, by a swivel joint 80 for movement about at least two orthogonal axes of rotation X, Y. In one embodiment, the swivel joint 80 can be a multi-axis Cardan joint as shown in the figures, but can alternatively comprise a ball joint. Wiring and/or conduits can optionally supply electricity and/or steam (or other fluids) between the wand 14, or steam unit 12, and the base 16, or vice versa, and can extend though the swivel joint 80.

The swivel joint 80 includes a coupler 82 that receives one end of the wand 14 or one end of the steam unit 12 (FIG. 4). A yoke 84 extends downwardly from the coupler 82 and is pivotally connected to the base 16 at spaced locations, with said pivotal connection defining the pivot axis X. A releasable latch for mounting the base 16 to the wand 14 or steam unit 12 is provided, and may include a button 86 carried by the coupler 82 that engages a detent (not shown) provided on the wand 14 or steam unit 12. Alternatively, the button 86 can be carried by the wand 14 or steam unit 12, with the detent provided in the base 16.

The base 16 can include a base housing 88 supporting at least some of the components of the fluid delivery and collection systems, such as a steam distributor 90 in fluid communication with the steam generator 22 (FIG. 5) in the steam unit 12 via the wand 14, a sweeping element 92 adapted to contact the surface to be cleaned to sweep dirt and liquid, and a collection bin 94 adapted to receive dirt and liquid swept by the sweeping element 92.

In FIG. 10, the sweeping element 92 is visible through a cover 96 forming a portion of the base housing 88. The cover 96 be at least partially formed from a translucent or transparent material, such that the sweeping element 92 is visible to the user through the cover 96. This can allow the user to view the sweeping element and ascertain if the sweeping element needs cleaning. As shown, the cover 96 can be formed with a viewing window or lens 97 in register with the brushroll 92, with the lens 97 being molded from a translucent or transparent material using plastic injection. Alternatively, the entire cover 96 can be molded from a translucent or transparent material using plastic injection molding. In other embodiments, the cover 96 may be opaque or may not be provided as part of the base housing 88.

The sweeping element 92 mechanically propels dirt and liquid into the collection bin 94. In one embodiment, the sweeping element 92 is a brushroll configured for rotation about a central rotational axis R for mechanically propelling dirt and liquid into the collection bin 94.

Figure 11:
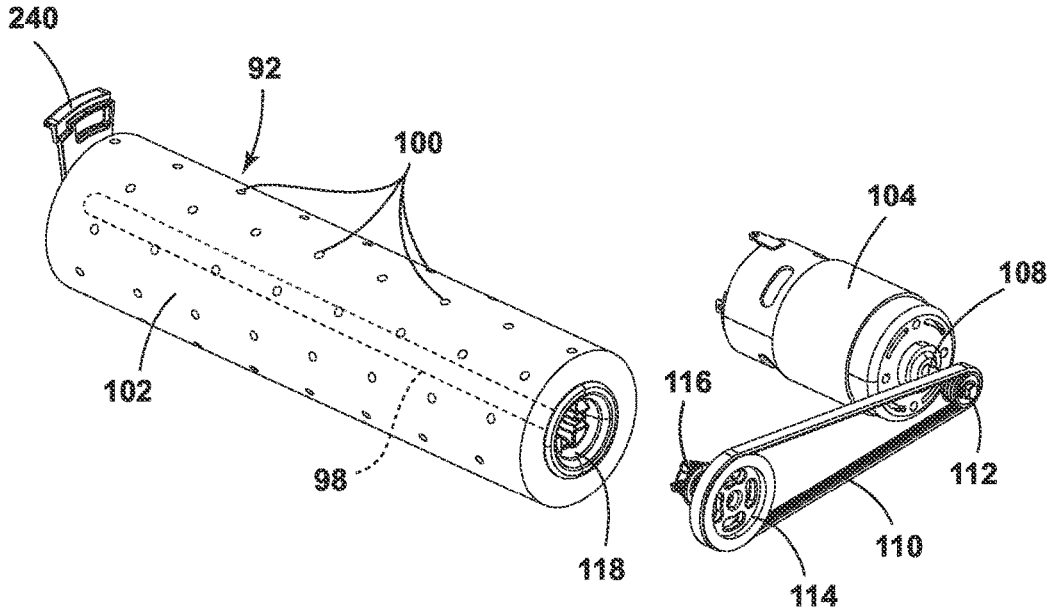
FIG. 11 is a perspective view of one embodiment of a brushroll and brushroll drive transmission for the surface cleaning apparatus of FIG. 1.

One embodiment of the brushroll 92 for the steam sweeper 10 is shown in FIG. 11. In the present example, brushroll 92 can be a hybrid brushroll suitable for wet mopping or dry sweeping. In one embodiment, the brushroll 92 comprises a dowel 98 (shown in phantom line in FIG. 11), a plurality of bristles 100 extending from the dowel 98, and microfiber material 102 provided on the dowel 98 and arranged between the bristles 100. One example of a suitable hybrid brushroll is disclosed in U.S. Pat. No. 10,092,155 to Xia et al., which is incorporated herein by reference in its entirety. The dowel 98 can be constructed of a polymeric material such as acrylonitrile butadiene styrene (ABS), polypropylene or styrene, or any other suitable material such as plastic, wood, or metal. The bristles 100 can be arranged in a plurality of tufts or in a unitary strip, and can be constructed of nylon, or any other suitable synthetic or natural fiber. The microfiber material 102 can be constructed of polyester, polyamides, or a conjugation of materials including polypropylene or any other suitable material known in the art from which to construct microfiber.

Other embodiments of the brushroll 92 are possible. For example, the brushroll 92 can comprise tufted bristles as the only sweeping medium. Alternatively, the brushroll 92 can comprise a sweeping medium made of a soft and compressible material, such as microfiber material. In still other embodiments, the brushroll 92 can comprise nylon fiber, foam, elastomeric blades and paddles, or any other sweeping medium suitable for mechanically propelling dirt and liquid into the collection bin 94. Additionally, while a horizontally-rotating brushroll 92 is shown herein, in some embodiments, dual horizontally-rotating brushrolls, one or more vertically-rotating brushrolls can be provided on the steam sweeper 10.

The collection system can further include a motor 104 drivingly connected to the brushroll 92. The brushroll 92 can be operably coupled to a brush motor 104 by a drive coupling or transmission that can comprise one or more belts, gears, shafts, pulleys or combinations thereof. One example of a transmission for the brushroll 92 is shown in FIG. 11. The transmission connects the brush motor 104 to the brushroll 92 for transmitting rotational motion of a shaft 108 of the brush motor 104 to the brushroll 92. The transmission can include a belt 110, a motor pulley 112 coupled with the motor 104 and a brushroll pulley 114 coupled with brushroll 92, with the belt 110 coupling the motor pulley 112 with the brushroll pulley 114. The transmission can further include a drive head 116 keyed to or otherwise fixed with the brushroll pulley 114. The drive head 116 can couple with the splined drive connection 118 of the brushroll 92. The opposite end of the brushroll 92 can be supported by a cradle or another suitable support within the base housing 88. The motor pulley 112 can be keyed to or otherwise fixed with the shaft 108 of the motor 104.

Figure 12:
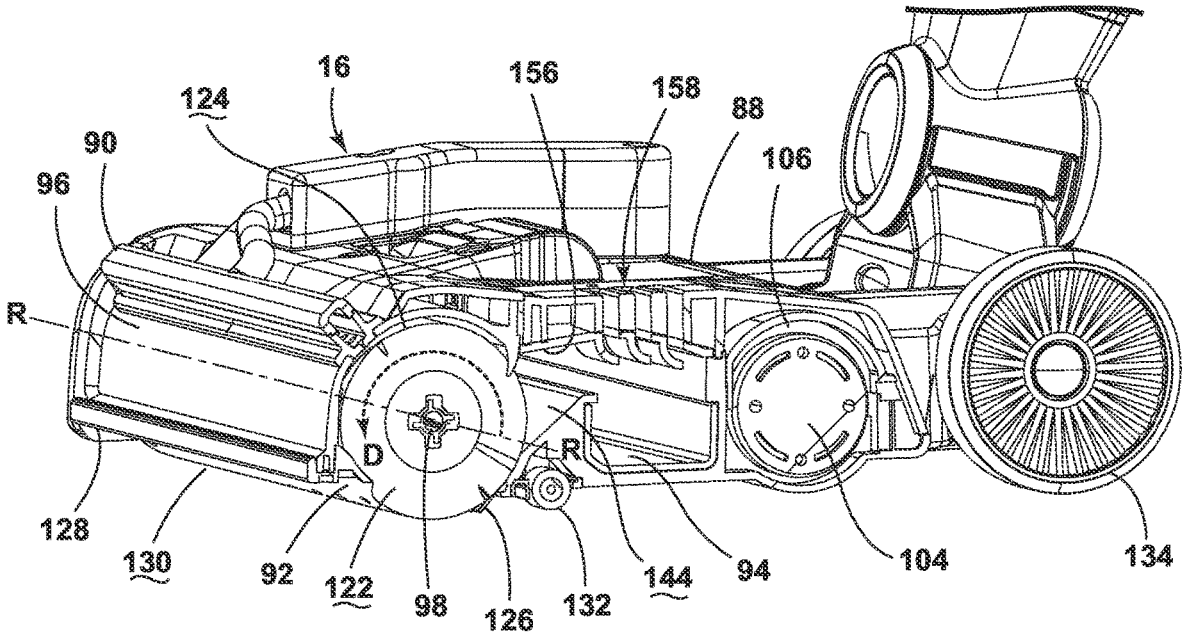
FIG. 12 is a perspective cross-sectional view through line XII-XII of FIG. 10.

Referring to FIG. 12, the brush motor 104 can be located in a compartment 106 at a rear of the base housing 88. Optionally, the collection bin 94 can be positioned between the brushroll 92 and the motor 104. The brush motor 104 can be operably coupled with the controller 45 in the steam unit 12 (FIG. 5) to provide brush motor control, and can be selectively energized via one of the input controls 49 on the user interface 47. Alternatively, the brush motor 104 can be controlled via an input control provided on the base 16. Regardless of its control location, the brush motor 104 can be operated independently of the pump actuator 30 so that steam can be dispensed when the brushroll 92 is rotating for simultaneous steam mopping and sweeping, the brushroll 92 can be turned off while still dispensing steam via the pump actuator 30 for a steam mopping-only mode, or the brushroll 92 can be turned on while not dispensing steam for a dry sweeping-only mode.

In an alternative embodiment, the brush motor 104 can be located inside of the brushroll 92. Examples of suitable motor-in-brushroll configurations are disclosed in U.S. Patent Application Publication No. 2017/0273523 to Kasper et al. and U.S. Pat. No. 6,400,048 to Nishimura et al., both of which are incorporated herein by reference in their entirety.

The collection system of the steam sweeper 10 is configured to remove dirt and liquid from the surface to be cleaned and store the collected dirt and liquid onboard the steam sweeper 10 for later disposal. The collection system can include at least a floor-facing opening 122, the sweeping element or brushroll 92, and the collection bin 94, and can be primarily or entirely located on the base 16. The opening 122 can be provided on the base housing 88 can be adapted to be adjacent the surface to be cleaned as the base 16 moves across a surface. The brushroll 92 can be provided adjacent to the opening 122 for sweeping the surface to be cleaned so that the dirt and liquid swept up by the brushroll 92 is mechanically propelled into the collection bin 94.

The brushroll 92 can be provided at a forward portion of the base 16 and received in a brush chamber 124 on the base 16. The brushroll 92 can be mounted for rotational movement in a direction D about the central rotational axis R defined by the dowel 98. The brush chamber 124 can be forward of the collection bin 94, and can be defined at least in part by the opening 122 and cover 96, as described in more detail below. A squeegee 126 can be mounted to the base housing 88, behind the brushroll 92, and can be configured to contact the surface as the base 16 moves across the surface to be cleaned.

The cover 96 can be provided at a forward portion of the base 16 and can optionally define at least the forward side of the base housing 88. The cover 96 can comprise a lower edge 128 defining a front opening 130 on the base 16. The lower edge 128 is spaced from the surface to be cleaned, such that a portion of the brushroll 92 is exposed from the front of the base 16 in addition to being exposed from the bottom of the base 16. The front opening 130 allows the base housing 88 to move over larger dirt on the surface to be cleaned, and prevents the base 16 from plowing larger dirt in front of the base housing 88 on forward strokes of the base 16. Larger dirt instead moves through the front opening 130 and is swept up by the brushroll 92. In one non-limiting example, the height of the front opening 130, i.e. the distance between a floor surface F over which the base 16 moves and the lower edge 128 can be >0 mm and ≤the length of the microfibers of the microfiber material 102. An exemplary floor surface F is shown in FIG. 13 in phantom line.

Wheels can be provided on the base housing 88 for ease of movement over the surface to be cleaned, and optionally can include a pair of front wheels 132 and a pair of rear wheels 134. The rear wheels 134 can be provided on rearward portion of the base housing 88, rearward of components such as the brushroll 92 and collection bin 94.

Figure 13:
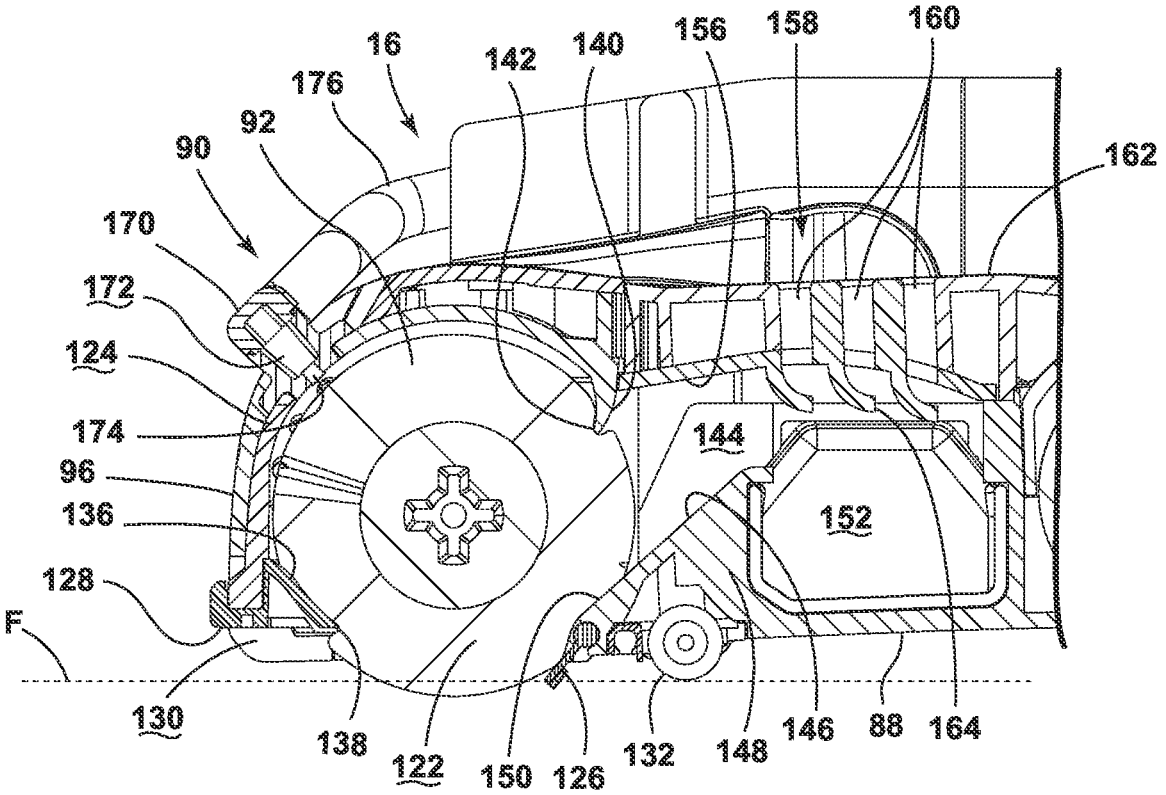
FIG. 13 is a cross-sectional view similar to FIG. 12, enlarged to show details of one embodiment of a brush chamber, collection bin, and relief vent for the surface cleaning apparatus of FIG. 1.

Referring to FIG. 13, the base 16 can include a front wiper 136 with a front interference edge 138 interfacing with the brushroll 92. The wiper 136 can be attached to the lower edge 128 of the cover 96, with the interference edge 138 extending rearwardly to face the brush chamber 124 and interface with the brushroll 92. Alternatively, the interference edge 138 can be integrally formed with the cover 96.

In at least some embodiments, the rotating brushroll 92 can function like a fan that pressurizes the brush chamber 124 and generates an air current that can blow dirt away from the opening 122 of the base 16. In a conventional vacuum cleaner, the air flow generated by the suction source far exceeds the negligible air current generated by a rotating brushroll. In a non-suction sweeper device, such as the steam sweeper 10, the air current generated by the brushroll can cause undesirable effects such as scattering and blowing dirt forwardly. The front wiper 136 functions as a guide to direct the air current from the brushroll 92 back into the brush chamber 124 and towards the collection bin 94, reducing or eliminating the scatting of dirt in front of the base 16.

The interference edge 138 can be a thin or narrow edge, such as a blade or scraper, and can be elongated transversely to extend along substantially the entire length of the brushroll 92. The interference edge 138 can further define a leading edge of the opening 122.

Figure 14:
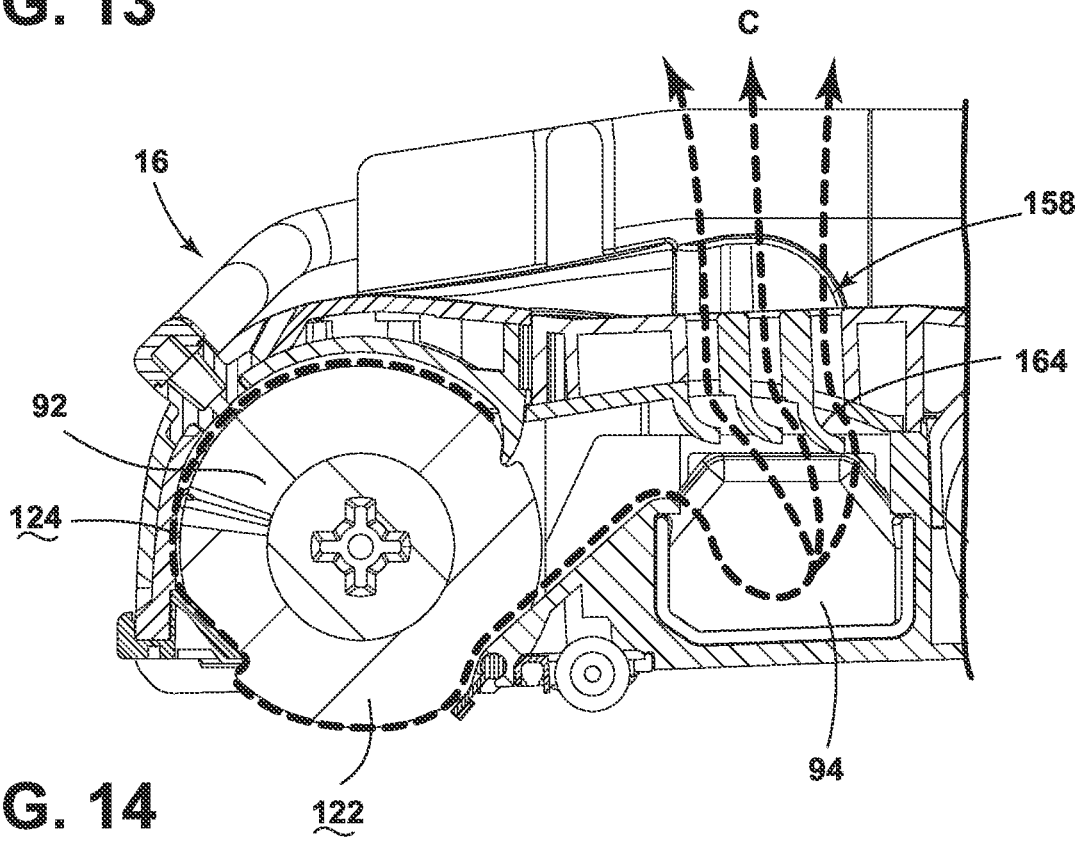
FIG. 14 is a view similar to FIG. 13, showing one embodiment of the air path through the brush chamber, collection bin, and relief vent.

The interference edge 138 is configured to engage with a leading portion of the brushroll 92, as defined by the direction of rotation D of the brushroll 92 about brush rotational axis R. Optionally, when viewed from the side as shown in FIG. 14, the interference edge 138 is configured to engage with a portion of the brushroll 92 in a lower front quadrant of the brushroll 92. As the brushroll 92 rotates, the interference edge 138 can help direct the air current generated by the rotating brushroll 92 back toward the collection bin 94 to reduce dirt plowing and scattering forwardly of the base 16. The interference edge 138 can also help direct steam along the leading side of the brushroll 92 and can scrape excess moisture off the brushroll 92, both of which can help redistribute the steam and moisture evenly along the length of the brushroll 92.

The front wiper 136 can be rigid, i.e. stiff and non-flexible, so the interference edge 138 does not yield or flex by engagement with the brushroll 92. In one example, the front wiper 136 can be formed of rigid thermoplastic material, such as poly(methyl methacrylate) (PMMA), polycarbonate, or acrylonitrile butadiene styrene (ABS).

The base 16 can include a rear wiper 140 with a rear interference edge 142 interfacing with the brushroll 92. The wiper 140 can extend from an inner surface of the cover 96, with the interference edge 142 extending downwardly and/or forwardly to face the brush chamber 124 and interface with the brushroll 92. Alternatively, the interference edge 142 can be separately formed and coupled to the cover 96 or another portion of the base housing 88.

The interference edge 142 is configured to engage with a trailing portion of the brushroll 92, as defined by the direction of rotation D of the brushroll 92 about brush rotational axis R. As the brushroll 92 rotates, the interference edge 142 can help remove dirt from the brushroll 92 and scrape excess liquid off the brushroll 92 to control the wetness level of the brushroll 92. Excess liquid can be swept into the collection bin 94. Optionally, when viewed from the side as shown in FIG. 13, the interference edge 142 is configured to engage with a portion of the brushroll 92 in an upper rear quadrant of the brushroll 92. As such, the interference edges 138, 142 can engage with opposing quadrants of the brushroll 92.

The interference edge 142 can be a thin or narrow edge, such as a blade or scraper, and can be elongated transversely to extend along substantially the entire length of the brushroll 92. The rear wiper 140 can be rigid, i.e. stiff and non-flexible, so the interference edge 142 does not yield or flex by engagement with the brushroll 92. In one example, the rear wiper 140 can be formed of rigid thermoplastic material, such as poly(methyl methacrylate) (PMMA), polycarbonate, or acrylonitrile butadiene styrene (ABS).

A ramp 146 can be provided at a rear portion of the brush chamber 124 for guiding dirt and liquid into the collection bin 94. The ramp 146 can define a lower side of a passage 144 leading to the collection bin 94. The passage 144 can extend at least partially between the brush chamber 124 and the collection bin 94 to Optionally, the ramp 146 itself can define part of the brush chamber 124, particularly a rear part of the brush chamber 124. The ramp 146 can extend upwardly from the rear side of the opening 122 to the collection bin 94. The ramp 146 can optionally form a portion of a divider 148 partitioning the brush chamber 124 off from the space in the base 16 that receives the collection bin 94, as explained in further detail below, and can aid in trapping any dirt or liquid removed from the surface to be cleaned by the sweeper 10 in the collection bin 94. In at least some embodiments, the ramp 146 can have an angle with respect to the floor surface F of >0 degrees and ≤90 degrees.

The squeegee 126 can be provided adjacent a trailing edge of the opening 122, behind the brushroll 92, in order to aid in dirt and liquid collection and is configured to contact the surface as the steam sweeper 10 moves across the surface to be cleaned. Particularly with respect to liquid on the surface to be cleaned, the squeegee 126 wipes residual liquid from the surface to be cleaned during a forward stroke or forward movement of the steam sweeper 10, so that it can be collected by the brushroll 92 on a backstroke or backward movement of the steam sweeper 10, thereby leaving a moisture and streak-free finish on the surface to be cleaned. As used herein, a stroke refers to movement of the steam sweeper 10 relative to the surface being cleaned in a single direction, from the perspective of a user positioned behind the steam sweeper 10.

The squeegee 126 can be an elongated blade that generally spans at least the width of the opening 122, or can generally span the width of the base 16, and can be supported by the base housing 88. Optionally, the squeegee 126 can be angled forwardly to encourage the squeegee 126 to skim over liquid and small dirt on a backstroke of the steam sweeper 10. Alternatively, the squeegee 126 can be disposed generally orthogonal to the surface to be cleaned, or vertically. The squeegee 126 can comprise a smooth forward-facing surface and a non-smooth rear surface, which decreases the contact area of the squeegee 126 with the surface to be cleaned on a backstroke of the steam sweeper 10 to reduce the push force required to move the steam sweeper 10. Alternatively, the squeegee 126 can have smooth front and rear surfaces or non-smooth front and rear surfaces.

The squeegee 126 can be coupled with lower end 150 of the ramp 146, and the lower end 150 can be configured to engage with a trailing portion of the brushroll 92, as defined by the direction of rotation D of the brushroll 92. As the brushroll 92 rotates, the lower end 150 of the ramp 146 compresses a portion of the brushroll 92, and the brushroll 92 can remain compressed against the lower end 150 of the ramp 146 a short distance before diverging from the ramp 146. Optionally, when viewed from the side as shown in FIG. 13, the lower end 150 of the ramp 146 is configured to engage with a portion of the brushroll 92 in a lower rear quadrant of the brushroll 92. As such, the squeegee 126 can engage with a different quadrant of the brushroll 92 than the interference edges 138, 142.

The squeegee 126 can be pliant, i.e. flexible or resilient, in order to bend readily according to the contour of the surface to be cleaned and/or the brushroll 92, yet remain undeformed by normal use of the steam sweeper 10. Optionally, the squeegee 126 can be formed of a resilient polymeric material, such as ethylene propylene diene monomer (EPDM) rubber, polyvinyl chloride (PVC), a rubber copolymer such as nitrile butadiene rubber, or any material known in the art of sufficient rigidity to remain substantially undeformed during normal use of the sweeper 10.

FIG. 13 shows the brushroll 92 uncompressed, whereas in operation, the brushroll 92 may be compressed where it engages the floor surface F, the front interference edge 138, the rear interference edge 142, and the lower end 150 of the ramp 146. FIG. 13 also shows the squeegee 126 unbent, whereas in operation, the squeegee 126 may be bent where it engages the floor surface F. On a forward stroke of the base 16, the squeegee 126 can bend backward about the lower end 150 of the ramp 146, with the forward-facing surface the squeegee 126 in contact with the floor surface F, and on a backstroke of the base 16, the squeegee 126 can bend forward with the rear surface in contact with the floor surface F.

The collection bin 94 can any type of bin, cup, container, or tank suitable for the purposes described herein, including the collection of dirt and liquid, and can define a collection chamber 152 for receiving the dirt and liquid mechanically propelled into the collection bin 94 by the brushroll 92. The collection bin 94 has a generally open top that defines an entrance opening into the collection chamber 152 and which is in fluid communication with the brush chamber 124. Dirt and liquid that is swept up by the brushroll 92 can be propelled through the passage 144 and into the entrance opening of the collection bin 94.

An inner cover 156 can define an upper side of the passage 144 leading to the collection bin 94. The inner cover 156 can extend over the open top of the collection bin 94.

In at least some embodiments of the brushroll 92, liquid swept up and absorbed by the rotating brushroll 92 can spin off the brushroll 92 and fly backwards into the collection bin 94. Some liquid may strike the inner cover 156 before dropping into the collection bin 94. The inner cover 156 can advantageously be angled downwardly in a rearward direction or toward the collection bin 94 to encourage liquid to drop or flow into the collection bin 94. Additionally, in embodiments where ramp 146 is present, some liquid spun off the brushroll 92 can fly along or above the ramp 146. Still further, in embodiments where the brushroll 92 comprises an absorbent material capable of absorbing liquid, such as microfiber material 102, some liquid can be absorbed by the brushroll 92. At least some of this absorbed liquid may be spun off the brushroll 92 and collected in the collection bin 94, and/or at least some of this absorbed liquid may be retained by the brushroll 92.

Referring to FIGS. 10 and 12-13, in at least some embodiments, the collection bin 94 can comprise at least one vent 158 serving as an outlet to relieve the positive pressure in the brush chamber 124. As noted above, the rotation of the brushroll 92 can positively pressurize the brush chamber 124, and in at least some embodiments, can generate an air current that can blow dirt away from the opening 122 of the base 16, causing the dirt to scatter rather than being collected. Without the at least one relief vent 158, the pressurized brush chamber 124 can blow dirt, particularly dry dirt, away from the opening 122, causing the dirt to scatter rather than being collected. In the embodiment shown in FIG. 10, two vents 158 can be provided, and can be spaced transversely from each other.

It is noted that 4 the front wiper 136 or the relief vent 158 may be employed alone on the steam sweeper 10 to reduce or eliminate dirt scattering due to the pressurized brush chamber 124. However, when used in combination on the steam sweeper 10, the front wiper 136 and the relief vent 158 may have superior performance compared to either the wiper or relief vent alone.

Referring to FIG. 13, the relief vent 158 can include a plurality of slots 160, which may be formed at an upper or top side of the base 16 and providing a passage for air from the collection bin 94 to the exterior of the base 16. The slots 160 can be formed by openings in the inner cover 156 and openings in an outer cover 162, the openings being at least partially aligned to provide a pressure relief passage through the covers 156, 162. The outer cover 162 can form at least an outer top surface of the base housing 88, or another portion of the base housing 88. In other embodiments, the base housing 88 may comprise only one cover or wall in which the vent 158, or slots 160 for the vent 158, is formed.

Optionally, the exit path through the at least one relief vent 158 can comprise a tortuous path to prevent dirt from escaping out of the collection bin 94 through the vent 158. In the present embodiment, the vent 158 can include one or more dirt deflectors 164 comprising arms or extensions extending below the slots 160. The deflectors 164 project downwardly and rearwardly to at least partially extend over on or more of the adjacent slots 160. Optionally, the deflectors 164 can be formed on or otherwise joined with the inner cover 156, and project internally toward the collection bin 94. The deflectors 164 are spaced vertically from the top of the ramp 146 so as not to block or impede the entry of dirt and liquid into the collection bin 94.

Alternatively or additionally to the tortuous path, a filter screen or mesh can provided over the at least one relief vent 158 to prevent dirt from escaping out of the collection bin 94.

FIG. 14 shows one embodiment of the air path through the brush chamber 124, collection bin 94, and relief vent 158. The rotating brushroll 92 pressurizes the brush chamber 124 and generates an air current C. The air current C, rather than blowing outwardly though the opening 122 of the base 16, flows back through the vent 158 to relieve the positive pressure in the brush chamber 124. The air current C follows the tortuous path as directed by the defectors 164, which prevents dirt from escaping out of the collection bin 94 through the vent 158.

Referring to FIG. 13, the steam distributor 90 delivers steam to the surface to be cleaned directly or indirectly. In the embodiment shown, the steam distributor 90 delivers steam to the surface to be cleaned indirectly by dispensing steam onto the brushroll 92. Alternatively, the fluid distributor 90 can be configured to dispense steam directly onto the floor surface F.

The steam distributor 90 can comprise a steam manifold 170 forming a sealed steam distribution channel path 172 to guide steam into the brush chamber 124. The steam manifold 170 defines a transversely-elongated steam path 172 having a plurality of openings or apertures 174 spaced along its length. The steam manifold 170 distributes and delivers steam to the brush chamber 124 and the brushroll 92 through the apertures 174. The plurality of apertures 174 are formed through an inner wall of the manifold 170 and defines a steam outlet of the distributor 90. Alternatively to having a plurality of apertures 174, the steam manifold 170 can have a single, narrow slit-like opening, a plurality of slits, or other shapes, including a plurality of openings of uniform or varying size.

Optionally, when viewed from the side as shown in FIG. 13, the steam manifold 170 is located at an upper front quadrant of the brushroll 92. As such, steam is disposed at a quadrant of the brushroll 92 lying in between the quadrants in which the interference edges 138, 142 engage the brushroll 92.

The steam manifold 170 can have at least one inlet tube 176 extending from a central portion of the steam path 172. The inlet tube 176 can be a rigid or flexible conduit. The steam manifold 170 and/or inlet tube 176 are shown herein as being on the exterior of the base housing 88. In other embodiments, the steam manifold 170 and/or inlet tube 176 can be provided within the interior of the base housing 88.

Figure 15:
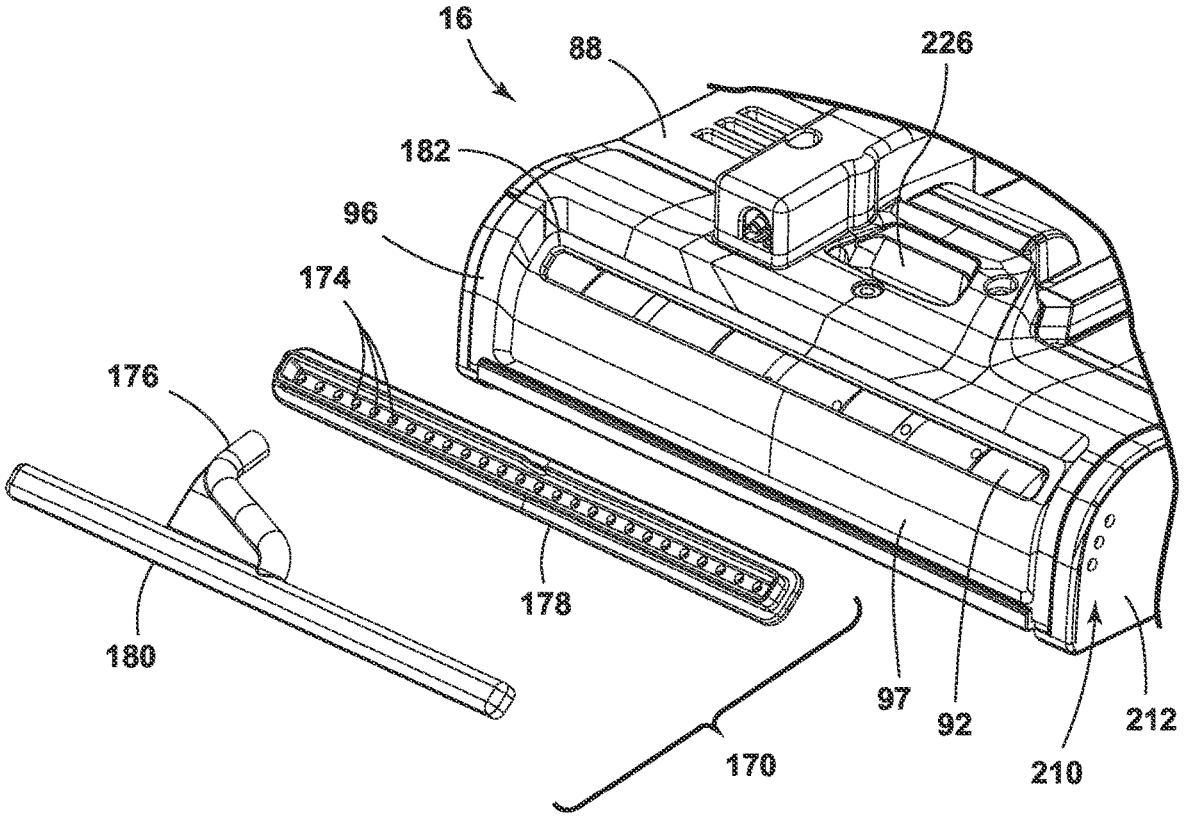
FIG. 15 is a perspective view of a front portion of the base, with a steam manifold exploded from the base housing.

Referring to FIG. 15, in one embodiment, the steam manifold 170 can have a two-piece design, with an inner manifold housing 178 and an outer manifold housing 180 that that mate together. Optionally, the inner and outer manifold housings 178, 180 mate with a tongue and groove joint, which prevents undesirable leaks along the steam distribution path 172 (FIG. 13). The plurality of apertures 174 can be formed in the inner manifold housing 178. The inlet tube 176 can be formed with the outer manifold housing 180 as shown, with the inner manifold housing 178, or separately from either housing 178, 180 and mated therewith.

The steam manifold 170 can be mounted on the cover 96 of the base 16. Optionally, the steam manifold 170 can be received within a slot 182 formed through the cover 96. The steam manifold 170 can be secured to the cover 96 with mechanical fasteners (not shown), sonic welding, adhesive, or another attachment means that form a sealed steam distribution path. In one embodiment, the steam manifold 170 can be molded from a translucent or transparent material using plastic injection molding, and attached to the lens 97 of the cover 96. The steam manifold 170 can alternatively be mounted elsewhere on the base housing 88, including within the base housing 88.

Figure 16:
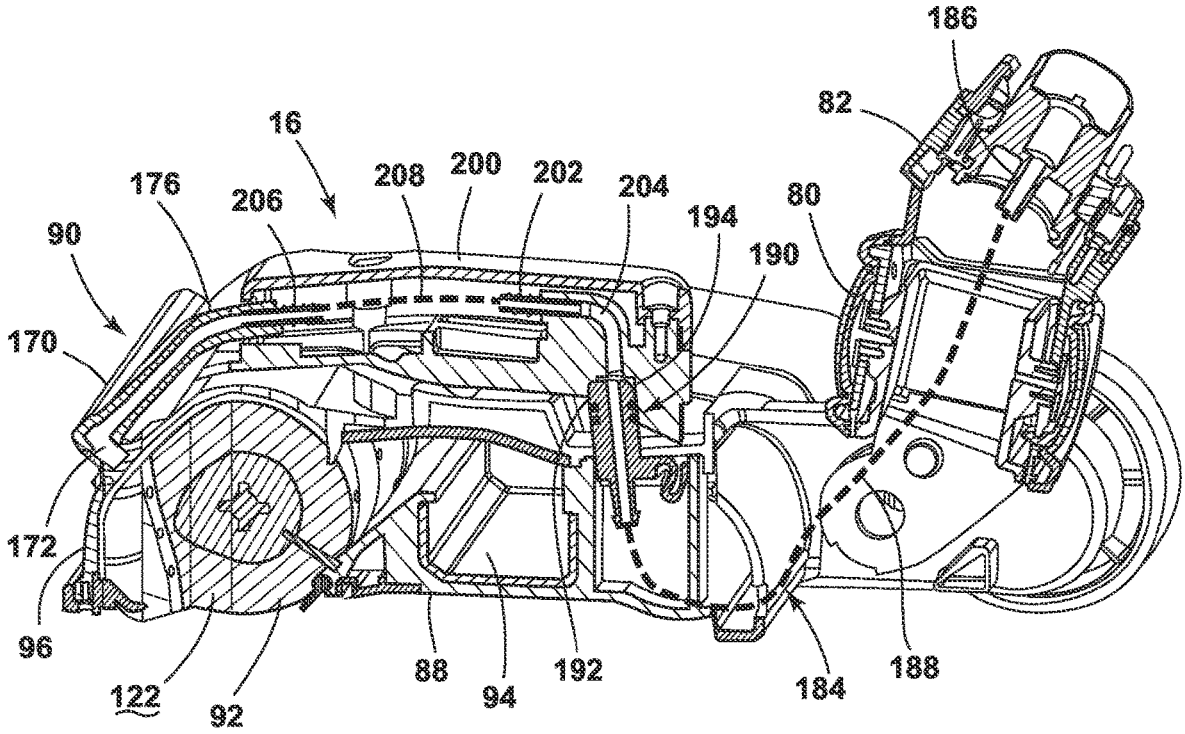
FIG. 16 is a sectional view take through line XVI-XVI of FIG. 10.

The steam distributor 90 is supplied with steam from the steam unit 12, optionally via the wand 14 in the upright or mopping mode of operation shown in FIG. 1, or directly from the steam unit 12 in the handheld accessory mode of operation shown in FIG. 4. Referring to FIG. 16, in either case, a steam supply pathway 184 of the base 16 supplies steam to the steam distributor 90, and can include one or more conduits, ducts, tubing, hoses, connectors, etc. in fluid communication with the steam distributor 90.

Optionally, a portion of the steam supply pathway 184 can extend through the swivel joint 80. In particular, the coupler 82 can include a steam conduit 186 that receives steam from the steam unit 12 (see FIG. 1 or FIG. 4). A flexible tubing 188 extends from the steam conduit 186 and into the base housing 88, and can bend and flex to accommodate for the movement of the swivel joint 80.

Figure 17:
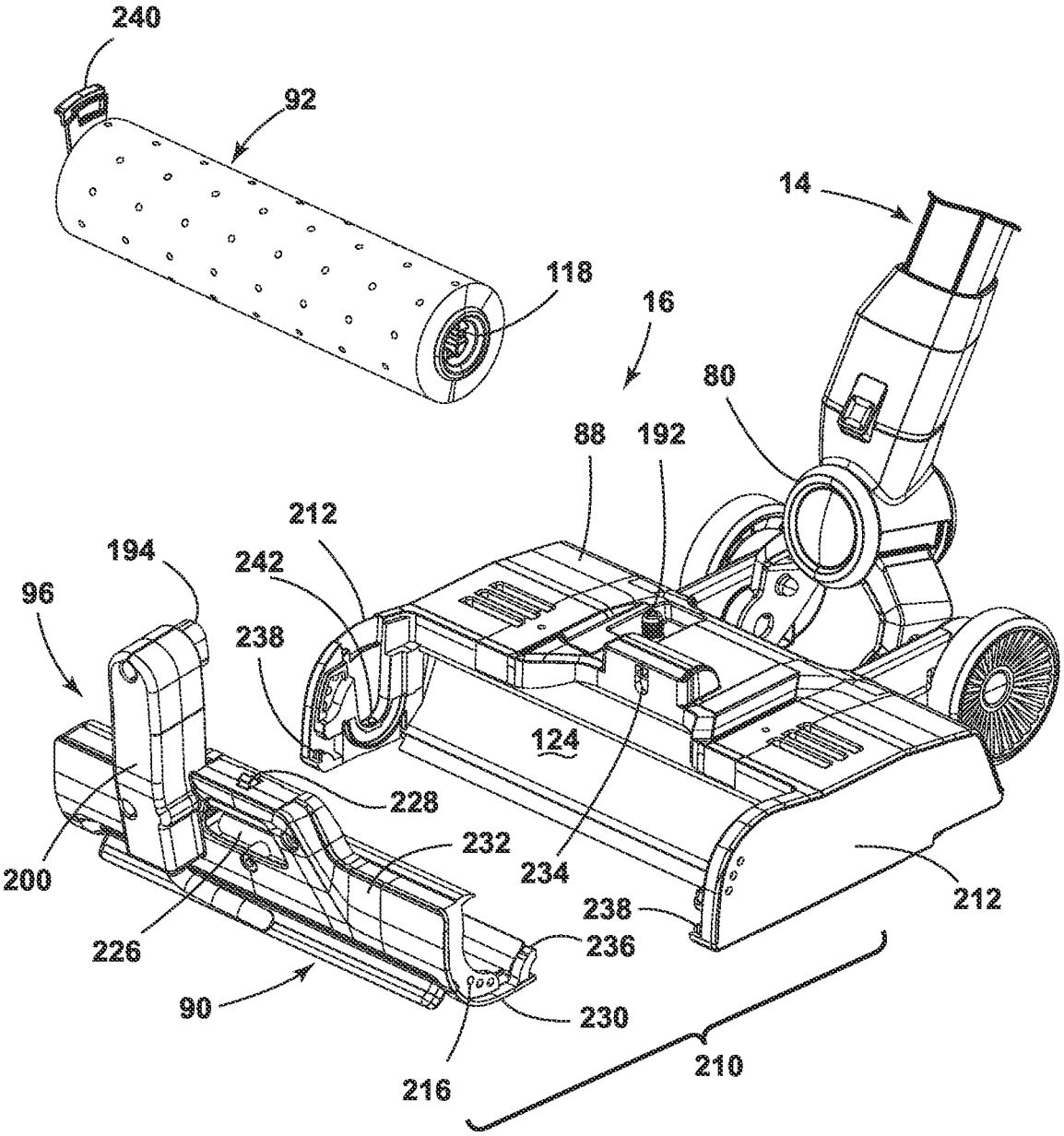
FIG. 17 is a perspective view of the base, showing a cover and a brushroll removed from the surface cleaning apparatus.

As will be described in further detail below, in some embodiments the cover 96 is openable for access to and removal of the brushroll 92. To accommodate for the movement of the cover 96, a portion of the steam supply pathway 184 can include a quick connect coupling 190, whereby the steam distributor 90 on the cover 96 can be quickly connected and unconnected to the source of steam by hand, i.e. by the closing or opening of the cover 96. Various configurations for the quick connect coupling are possible. In the illustrated embodiment, the quick connect coupling includes a first fluid coupler 192 on the base housing 88 and a second fluid coupler 194 on the cover 96. When the cover 96 is closed, as shown in FIG. 16, the second fluid coupler 194 automatically couples with the first fluid coupler 192 to establish fluid communication between the steam distributor 90 and the steam supply. When the cover 96 is opened, for example as shown in FIG. 17, the second fluid coupler 194 automatically decouples or disconnects from the first fluid coupler 192 to break the fluid communication.

The first fluid coupler 192 can comprise a fitting, and the second fluid coupler 194 can comprise a receiver configured to receive the fitting. One end of the fitting 192 can mate with the flexile tubing 188. O-rings (not shown) can be provided on the fitting 192 to seal the interface with the receiver 194. In other embodiments, the second fluid coupler 194 can comprise the fitting, and the first fluid coupler 192 can comprise the receiver.

The steam supply pathway 184 can further include a portion extending through or along the cover 96, from the second fluid coupler 194 to the steam distributor 90. This portion of the steam supply pathway 184 remains with the cover 96 when the cover 96 is opened for access to and removal of the brushroll 92, for example as shown in FIG. 17. The base housing 88 can comprise an enclosure 200 covering this portion of the steam supply pathway 184.

In the embodiment shown, the portion of the steam supply pathway 184 extending through or along the cover 96 includes a first tube fitting 202 in fluid communication with the second fluid coupler 194 via a first conduit 204 and a second tube fitting 206 in fluid communication with the first tube fitting 202 via a second conduit 208. The inlet tube 176 of the steam manifold 170 can mate with the second tube fitting 206. At least the tube fittings 202, 206 and second conduit 208 can be housed by the enclosure 200. The conduits 204, 208 can be rigid or flexible conduits. Other configurations for this portion of the steam supply pathway 184 are possible, including various other combinations of conduits, ducts, tubing, hoses, connectors, etc.

Referring to FIG. 10, in at least some embodiments, at least one steam vent 210 can be provided to allow a portion of the steam dispensed by the steam distributor 90 to escape from the brush chamber 124. Allowing a portion of the steam to escape the brush chamber 124, rather than being applied to the brushroll 92 or floor surface via the opening 122, can relieve pressure at the opening 122 that may otherwise cause plowing or scattering of dirt. The steam vent 210 can improve visibility of dispensed steam, providing a visual confirmation to the user that steam is being generated and dispensed to the base 16. Each steam vent 210 can include a plurality of openings or apertures 214. Alternatively, the steam vent 210 can have a single, narrow slit-like opening, a plurality of slits, or other shapes.

In one embodiment, two steam vents 210 (see FIG. 10 and FIG. 15) are configured to dispense steam outwardly from the base 16. More specifically, the steam vents 210 can dispense steam laterally from the base 16, i.e. outwardly from lateral sides 212 of the base housing 88. As shown, the steam vents 210 are provided in both lateral sides 212 of the base housing 88, optionally at the ends of the brush chamber 124. In other embodiments, the steam vents 210 can be provided elsewhere on the base 16 and can be configured to deliver steam forwardly, rearwardly, and/or upwardly from the base 16.

Referring to FIG. 17, the apertures 210 can be formed by openings in end walls 216 of the cover 96 and second openings in lateral sides 212 of the base housing 88, the openings being at least partially aligned to provide a passage from the brush chamber 124 to the exterior of the base 16. In other embodiments, the apertures 210 may be formed by openings extend through only one cover or wall of the base housing 88.

Figure 18:
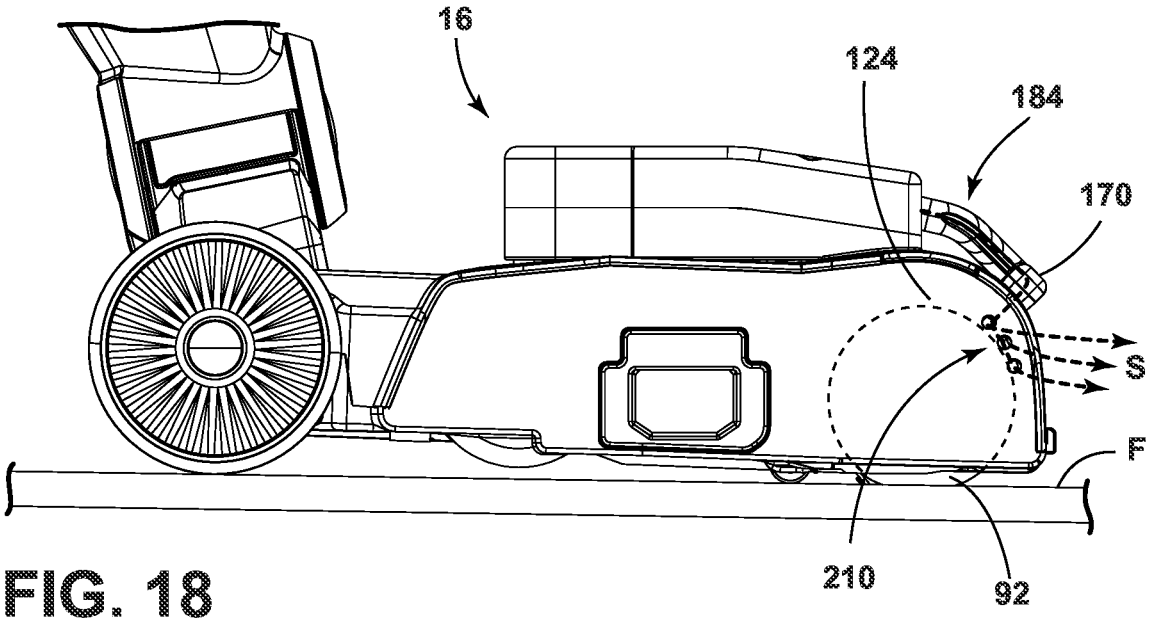
FIG. 18 is a side view of the base showing one embodiment of the steam path through the brush chamber and steam vent.

FIG. 18 shows one embodiment of the steam path through the steam pathway 184, brush chamber 124, and steam vents 210. The steam pathway 184 supplies steam S to the brush chamber 124 via the steam manifold 170. A portion of the steam S is applied to the brushroll 92 and indirectly delivered to the floor F via the brushroll 92. Another portion of the steam S is vented out of the brush chamber 124 via the steam vents 210. The vented steam S can be in the form of a visible mist formed when gas or vapor condenses in air, invisible to the naked eye, or a combination thereof.

Figure 19:
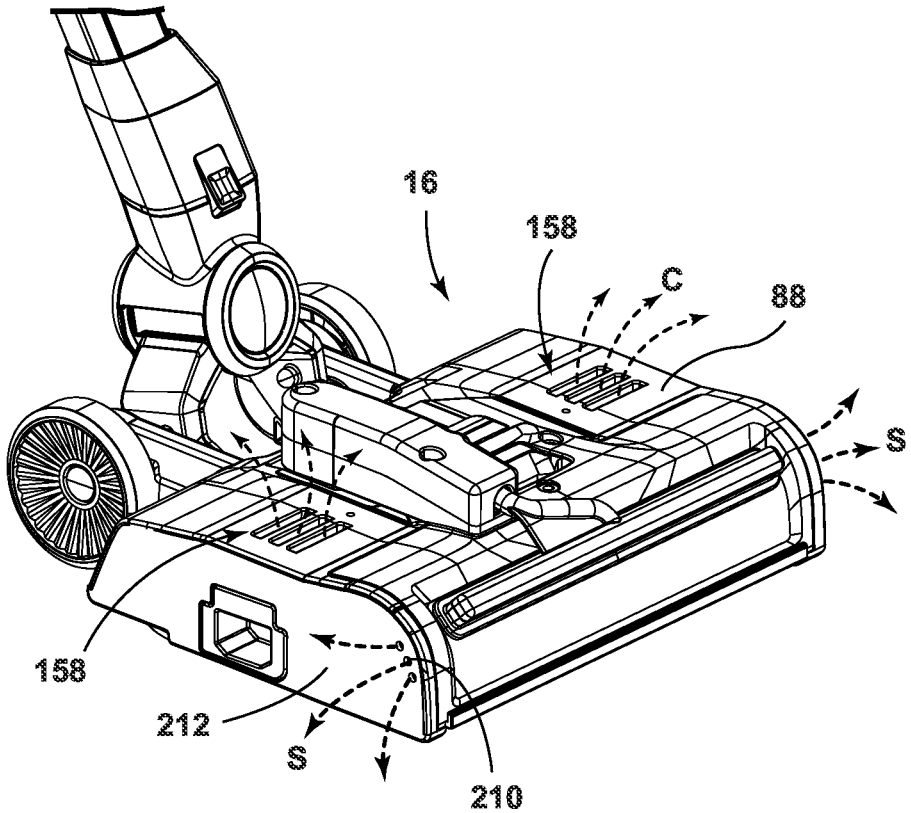
FIG. 19 is a perspective view of the base, showing air exiting the relief vents and steam exiting the steam vents.

FIG. 19 shows both the air venting and steam venting of the base 16. As described above, air current C flows through the transversely-spaced relief vents 158 on the base housing 88 and steam S flows through steam vents 210 on either lateral side 212 of the base housing 88.

Referring to FIG. 17, in one embodiment, the cover 96 can comprise a removable cover on the base housing 88 that encloses the brushroll 92 or other sweeping element and defines a portion of the brush chamber 124. The cover 96 can be removed from a portion of the base housing 88 that includes the swivel joint 80 so that the cover 96 can conveniently be removed without having to separate the wand 14 from the base 16. The cover 96 can be received on a front or forward side of the base housing 88 and extends between the lateral sides 212, although other configurations of the base housing 88 are possible. By removing the cover 96, the brushroll 92 and/or brush chamber 124 can be easily accessed for cleaning or maintenance. Alternatively to a complete removal of the cover 96, the cover 96 can be opened for access to and removal of the brushroll 92, while still remaining attached to the base housing 88.

The cover 96 can be removable from the base housing 88 without the use of tools. The cover 96 can comprise a hand grip, such as a carry handle 226 that can be used to lift the cover 96 away from the base housing 88.

Optionally, the cover 96 can have a cover latch 228 to releasably secure the cover 96 on the base housing 88. When secured on the base housing 88, the cover 96 can define at least a portion of the brush chamber 124 that partially encloses the brushroll 92. In the illustrated embodiment, the cover 96 includes a curved forward end 230 that can wrap around and in front of the brushroll 92 to define the brush chamber 124 and a rearward end 232 that can include the cover latch 228. The enclosure 200 can extend rearwardly from the rearward end 232, with the second fluid coupler 194 disposed on one end of the enclosure 200 spaced from the rearward end 232 of the cover 96.

The cover latch 228 can be provided to releasably secure the cover 96 on the base housing 88, and can be configured to releasably latch or retain, but not lock, the cover 96 to the base housing 88, such that a user can conveniently apply sufficient force to the cover 96 itself, such as via the carry handle 226, to pull the cover 96 off the base housing 88. The cover latch 228 can be received in a latch catch 234 provided on the base housing 88.

The cover 96 can include a hook-and-catch mechanism wherein a hook 236 on the cover 96 engages with a pivot 238 on the base housing 88. A user can grasp the handle 226 and pull to disengage the cover latch 228 from the latch catch 234. Continued rotation of the cover 96 forwardly about the pivot 238 moves the hook 236 out of engagement with the pivot 238. The cover 96 can thereafter be lifted away from the base housing 88.

Optionally, the brushroll 92 can be configured to be removed by the user from the base 16, such as for cleaning and/or drying the brushroll 92. The brushroll 92 can be removably mounted in the brush chamber 124 by a brushroll latch 240 that is coupled with the brushroll 92. Accordingly, the cover 96 may be removed from the base housing 88 prior to removing the brushroll 92. In other embodiments, the brushroll 92 and latch 240 can be configured such that prior removal of the cover 96 is not required.

The brushroll latch 240 can be received by a mating component on the base housing 88. The mating component can be provided at a lateral side 212 of the base 16. In one embodiment, the base housing 88 can include spaced lateral sidewalls 212 that define the brush chamber 124 therebetween. The mating component can comprise a cradle 242 provided on an inner surface of one of the lateral sidewalls 212. The brushroll latch 240 can be provided on one end of the brushroll 92 and received within the cradle 242 to mount the brushroll 92 within the brush chamber 124. The user can grip the latch 240 to remove the brushroll 92 from the brush chamber 124. The opposite end of the brushroll 92 can have the splined drive connection 118 with the transmission for driving the brushroll 92, as described above (see FIG. 11).

Figure 20:
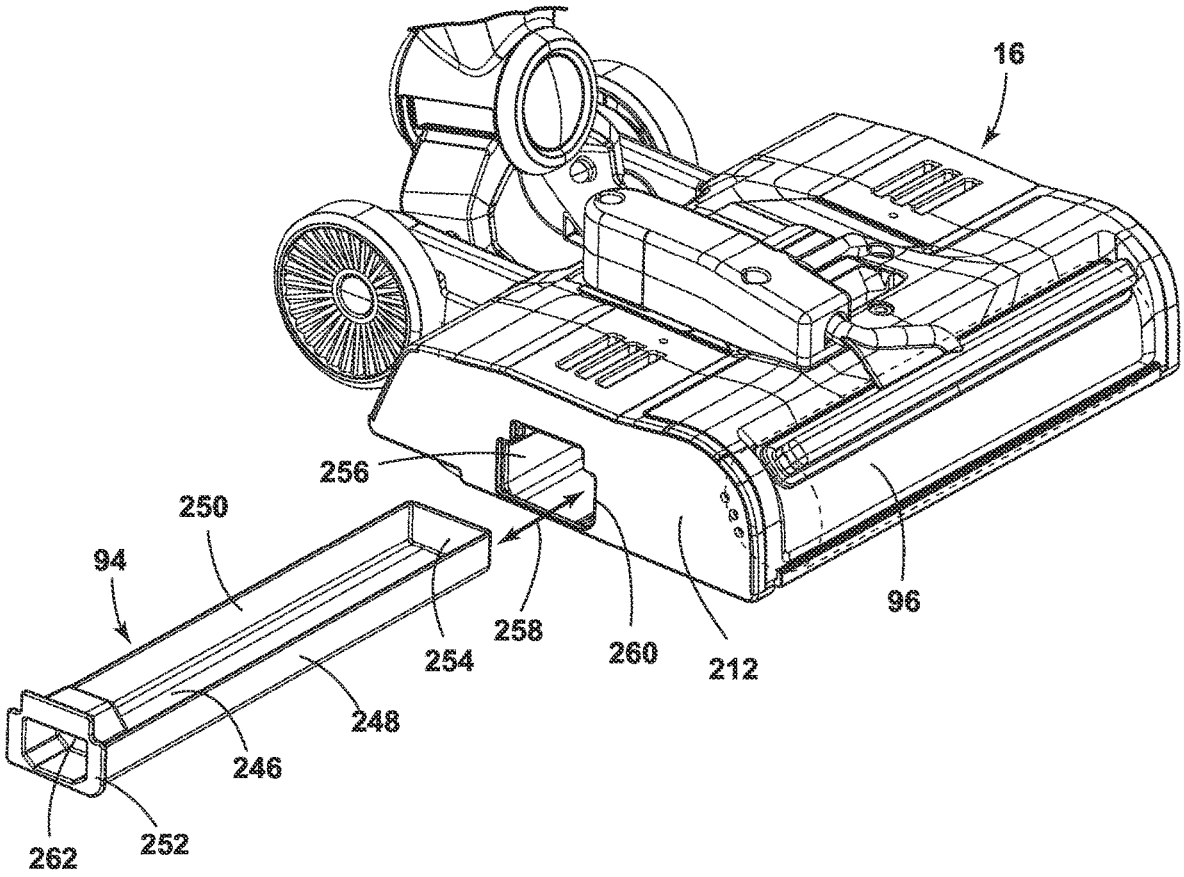
FIG. 20 is a perspective view of the base, showing a collection bin removed from the surface cleaning apparatus.

Referring to FIG. 20, in the illustrated embodiment, the collection bin 94 is elongated transversely, and can be rectilinear in shape, including a closed bottom wall 246, spaced front and rear side walls 248, 250, and lateral side walls 252, 254 extending between the front and rear walls 248, 250. The side walls 248-254 can collectively define the open top or entrance opening into the collection chamber 152.

The collection bin 94 can be removable from the base 16 for emptying. The base 16 can include a collection cup receiver, such as a collection cup pocket 256, for receiving the collection bin 94. As shown herein, in one embodiment, the pocket 256 can be defined by portions of the base housing 88 and the cover 96. The collection bin 94 can slide into the pocket 256 to install the collection bin 94 on the base 16 and can slide out of the pocket 256 to remove the collection bin 94 from the base 16. FIG. 20 and shows the direction of bin insertion and removal with arrow 258.

In one embodiment, the collection bin 94 can be removed through the lateral side 212 of the base housing 88 for emptying. The collection bin 94 can slide out of the base housing 88 transversely to remove the collection bin 94 from the base 16. In the embodiment illustrated herein with the pocket 256, the pocket 256 can comprise a pocket opening 260 at the lateral side 212 of the base housing 88 through which the collection bin 94 can transversely slide.

A handle 262 can be provided on the collection bin 94 to facilitate the removal of the collection bin 94 from the base 16 for emptying. In the illustrated embodiment, the handle 262 can be provided on the lateral side wall 252 of the collection bin 94.

In the embodiment shown herein, the collection bin 94 can be removed from the base 16 for emptying, without removing the cover 96. Alternatively, the collection bin 94 can be coupled with or otherwise combined with the cover 96 such that removing the cover 96 also removes the collection bin 94 for easy cleanout of both the brush chamber 124 and the collection bin 94 at the same time.

Optionally, the collection bin 94 can have a latch (not shown) for securing the bin 94 to the base 16. For example, a detent or push button release latch can be provided to secure the collection bin 94 within the pocket 256. The collection bin latch can be configured to releasably lock the collection bin 94 on the base 16 so that that a user must actuate the latch before removing the collection bin 94 from the base 16. Alternatively, collection bin latch can be configured to releasably latch or retain, but not lock, the collection bin 94 on the base 16, such that a user can conveniently apply sufficient force to the collection bin 94 itself to pull the collection bin 94 off the base 16.

Figure 21:
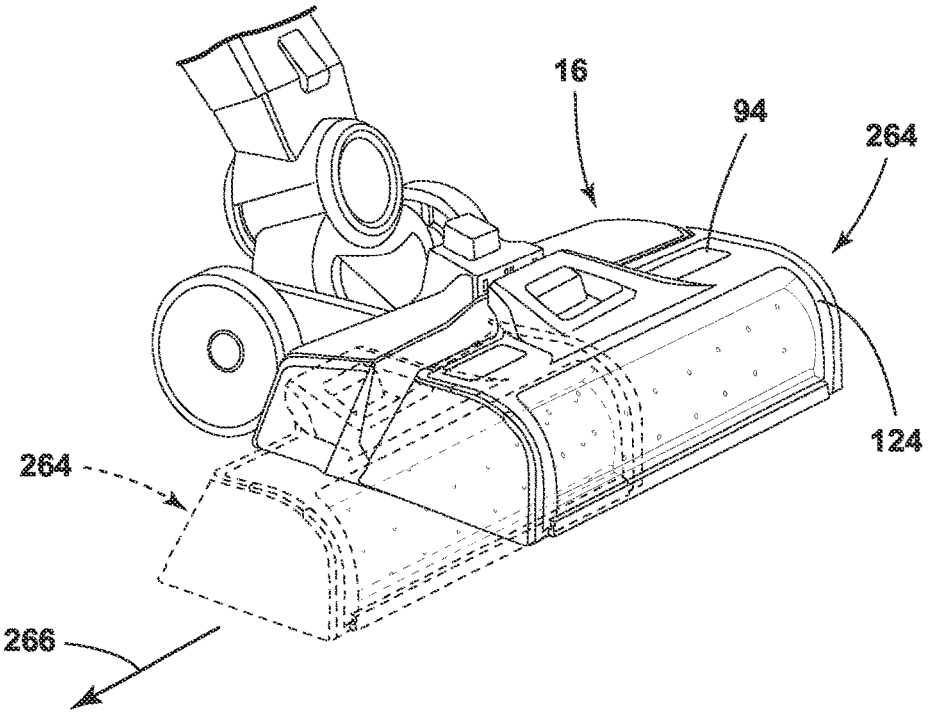
FIG. 21 is a perspective view of another embodiment of the base of the surface cleaning apparatus, illustrating the removal of a bin/brushroll module from the base.
Figure 22:
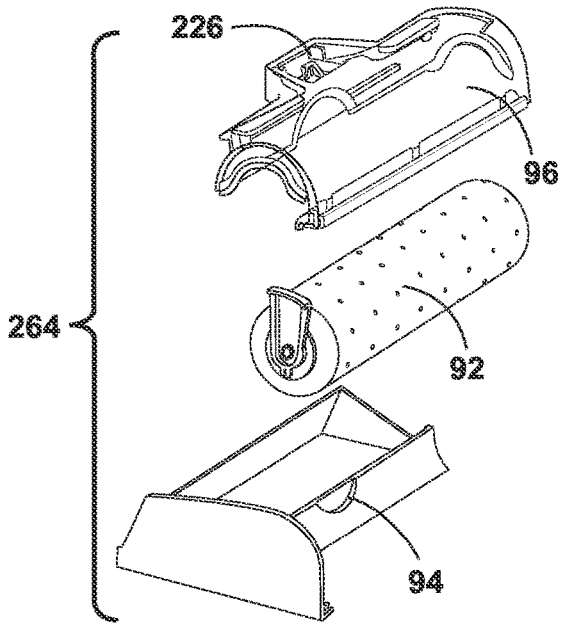
FIG. 22 is an exploded view of the bin/brushroll module from FIG. 21.

FIG. 21 shows an alternative embodiment of the base 16, where the brushroll 92 and collection bin 94 are removed together in one action and comprise an integrated assembly or bin/brushroll module 264 for ease of cleaning. In one embodiment, the bin/brushroll module 264 can include at least the collection bin 94, brush chamber 124, brushroll 92, and cover 96. The collection bin 94 can be coupled with or otherwise combined with the brush chamber 124 and cover 96 such that removing the collection bin 94 also removes the brushroll 92. In one embodiment, the bin/brushroll module 264 can be removed from the base 16 by sliding the module 264 laterally as indicated by arrow 266. After removal of the bin/brushroll module 264, the brushroll 92 and collection bin 94 can be removed from the brush chamber 124 as shown in FIG. 22.

Figure 23:
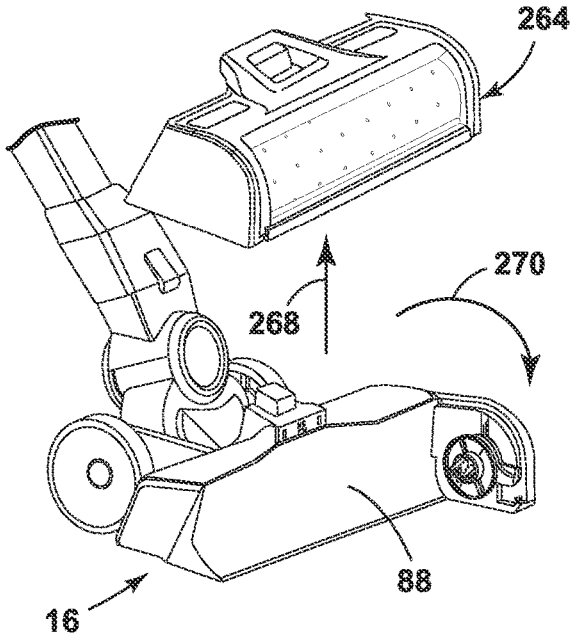
FIG. 23 is a perspective view of yet another embodiment of the base of the surface cleaning apparatus, illustrating the removal of a bin/brushroll module from the base.

FIG. 23 shows another alternative embodiment of the base 16, where the bin/brushroll module 264 can be removed from the base 16 by lifting the module 264 upwardly away from the base housing 88 as indicated by arrow 268. In yet another alternative embodiment, the bin/brushroll module 264 can be removed from the base 16 by pivoting the module 264 forwardly from the base housing 88, as indicated by arrow 270. In either case, after removal of the bin/brushroll module 264, the brushroll 92 and collection bin 94 can be removed from the brush chamber 124 as shown in FIG. 22.

Figure 24:
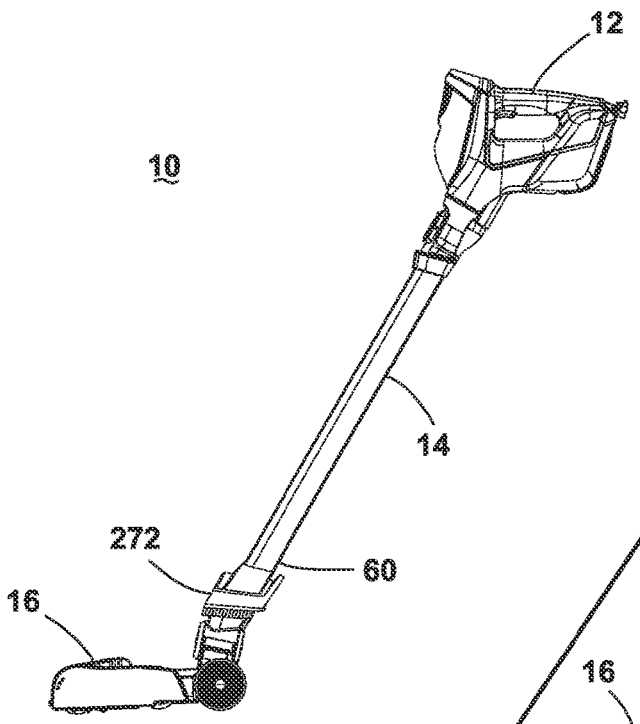
FIG. 24 is a perspective view of a surface cleaning apparatus in the form of a convertible steam sweeper according to another embodiment of the invention, with the steam sweeper in an upright or mopping mode of operation.
Figure 25:
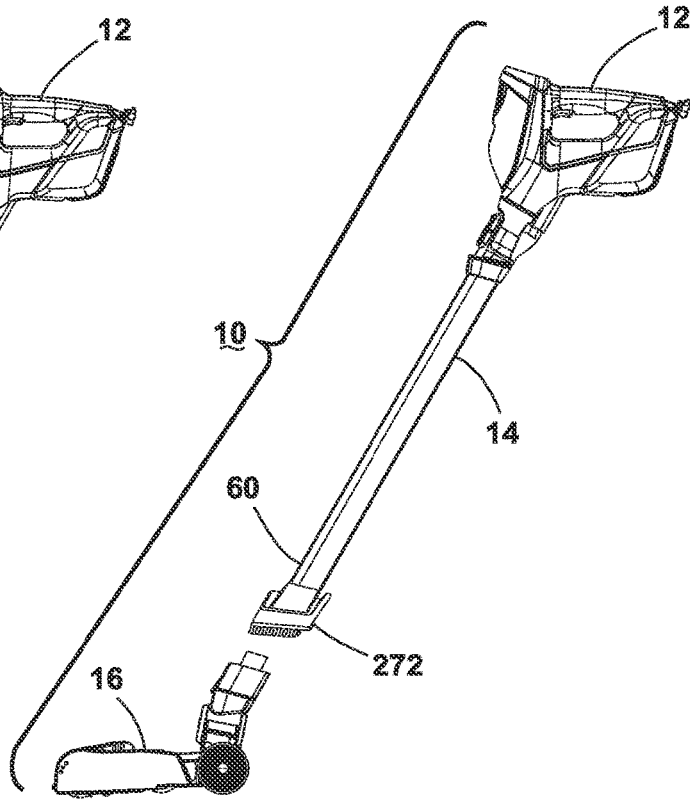
FIG. 25 is a perspective view of the surface cleaning apparatus of FIG. 24 in a remote cleaning mode of operation or scrubbing mode.

FIGS. 24-25 show another embodiment of the steam sweeper 10, where the wand 14 includes a scrubbing brush 272 on the distal end 60 of the wand 14 for agitating stuck on stains, spots, or other dirt. As shown in FIG. 24, when the base 16 is coupled with the wand 14, the scrubbing brush 272 is inaccessible for use. Separation of the wand 14 from the base 16, as shown in FIG. 25, exposes the scrubbing brush 272 for use.

The scrubbing brush 272 can have a smaller area of contact with the surface to be cleaned than the brushroll 92, and so the force exerted by the user using the scrubbing brush 272 translates to more pressure being applied to the surface, which may facilitate the removal of stubborn or stuck-on stains. Steam can be selectively distributed onto the surface to be cleaned when the steam sweeper 10 is used in the remote cleaning mode of operation, or scrubbing mode, shown in FIG. 25. In this configuration, steam is distributed through the wand nozzle 62 (FIG. 9) and passes through a center of the scrubbing brush 272 onto the surface to be cleaned for focused steam delivery.

Figure 26:
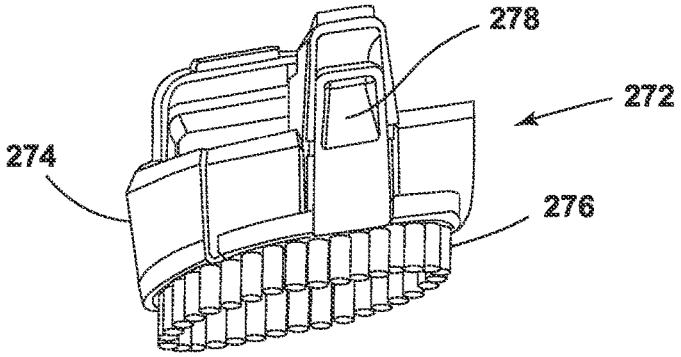
FIG. 26 is a rear perspective view of one embodiment of a scrubbing brush for the surface cleaning apparatus of FIG. 24.

Referring to FIG. 26, the scrubbing brush 272 can comprise a body 274 supporting a plurality of bristles 276. Other agitators can be used, such as a wool, cotton, or synthetic scrubbing pad, an absorbent or soil attracting mopping cloth, or elastomeric scrubbing nubs. The scrubbing brush 272 can be at least partially hollow to permit a portion of the steam delivery pathway to extend through the scrubbing brush 272.

The scrubbing brush 272 is also selectively removable from the wand 14. The scrubbing brush 272 includes a spring-biased release latch 278 and can be removed from the wand 14 for cleaning or replacement, to use the wand 14 without the scrubbing brush 272, or to use the wand 14 with another accessory tool.

Figure 27:
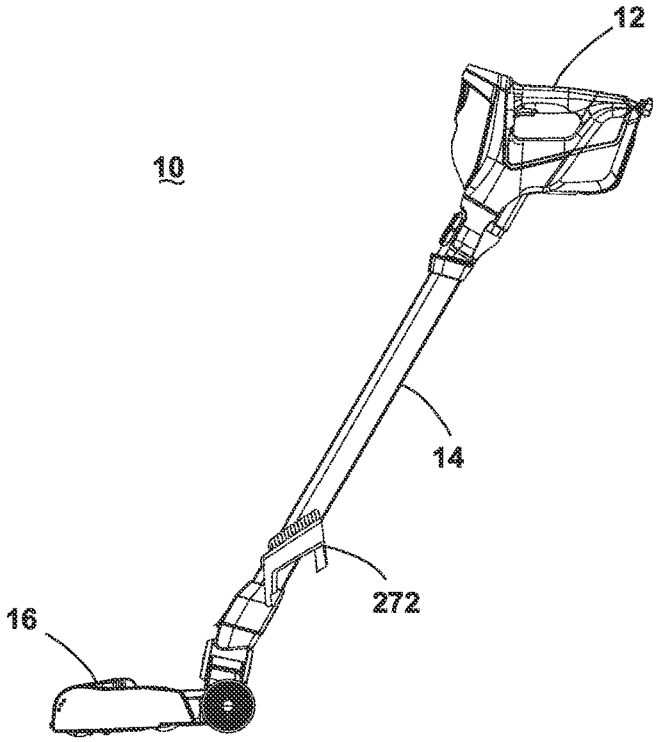
FIG. 27 is a perspective view of a surface cleaning apparatus in the form of a convertible steam sweeper according to yet another embodiment of the invention, with the steam sweeper in an upright or mopping mode of operation.
Figure 28:
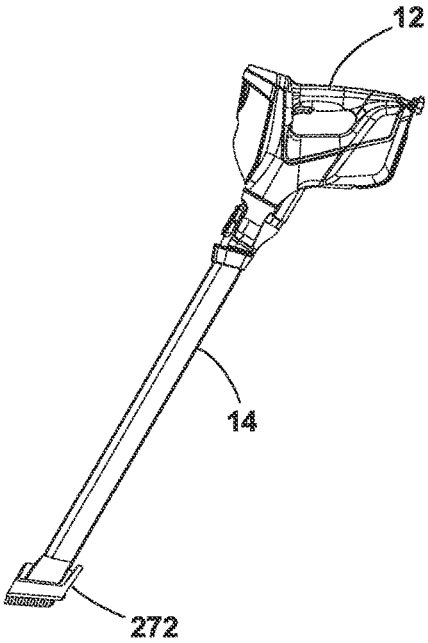
FIG. 28 is a perspective view of the surface cleaning apparatus of FIG. 27 in a remote cleaning mode of operation or scrubbing mode.

FIGS. 27-28 shows another embodiment of the steam sweeper 10 where the wand 14 includes the scrubbing brush 272. In this embodiment, the scrubbing brush 272 is movable between at least a first position (FIG. 27) and a second position (FIG. 28). In the first position, the electrical connector 74 at the distal end 60 is exposed, and can be connected with connector 78 (see FIG. 9) provided on the base 16. In the second position, the scrubbing brush 272 covers the electrical connector 74 to protect the electrical connector 74 from steam and liquid.

According to the illustrated embodiment, scrubbing brush 272 pivots with respect to the wand housing 56 about a pivot joint 280. The act of pivoting about the pivot joint 280 moves the body 274 in an arc generally indicted by the phantom line path 282 in FIG. 29, from the first position where the body 274 is flipped up for storage or non-use at the rear of the wand 14, to the second position wherein the body 274 is pivoted down for use at the lower end of the wand 14.

Figure 30:
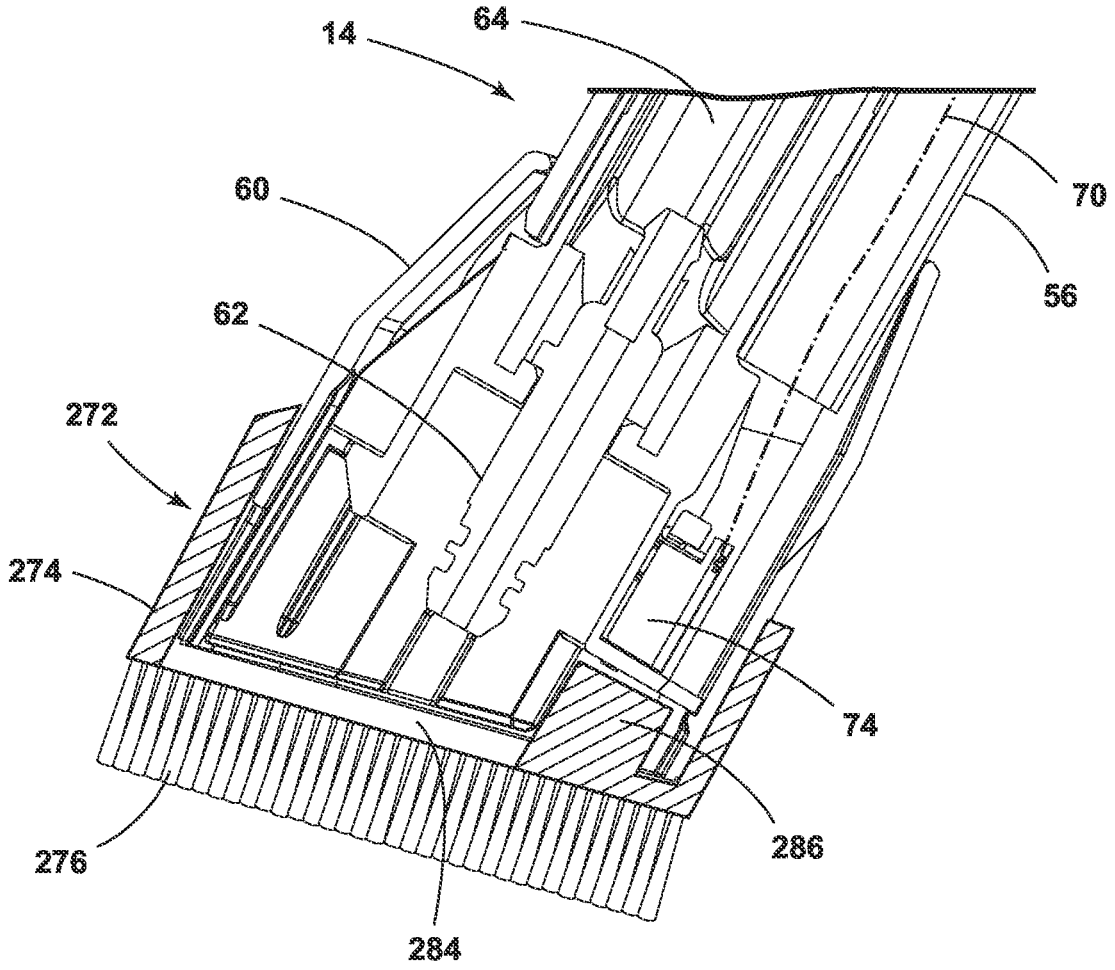
FIG. 30 is a cross-sectional view through a distal end of the wand, with the scrubbing brush in the second scrubbing position.
Figure 31:
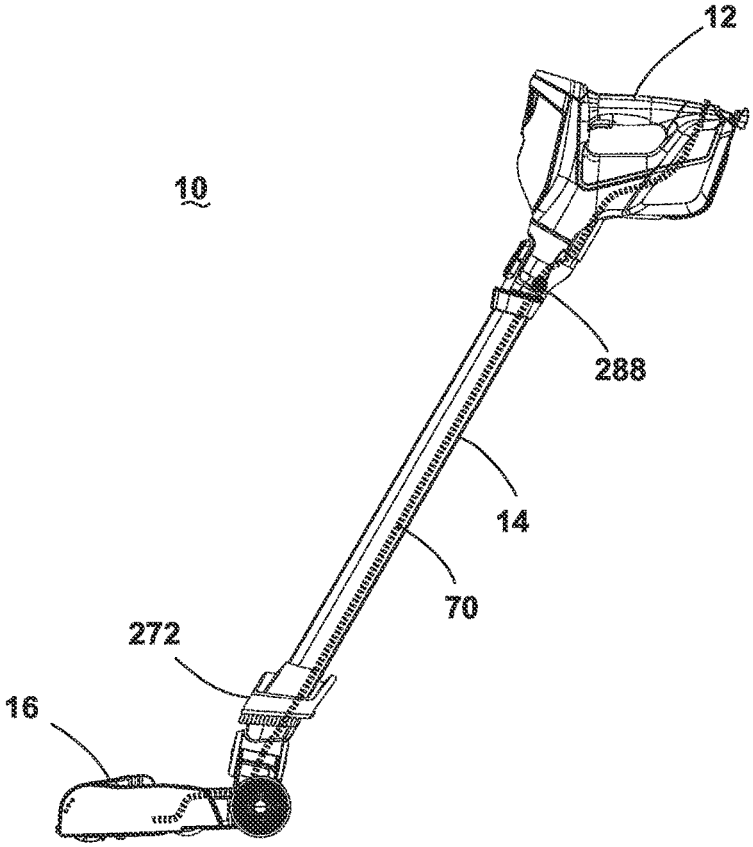
FIG. 31 is a perspective view of a surface cleaning apparatus in the form of a convertible steam sweeper according to still another embodiment of the invention, with the steam sweeper in an upright or mopping mode of operation and where power to the wand and base is turned on by a switch.
Figure 32:
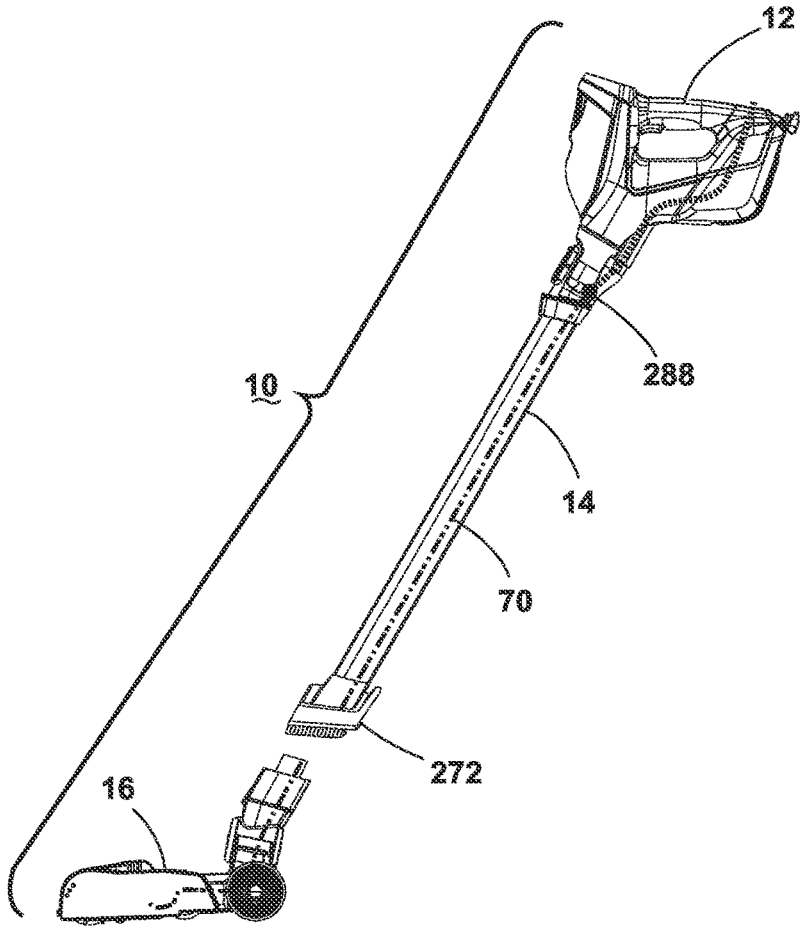
FIG. 32 is a perspective view of the surface cleaning apparatus of FIG. 31 in a remote cleaning mode of operation or scrubbing mode, and where power to the wand and base is turned off by the switch.
Figure 33:
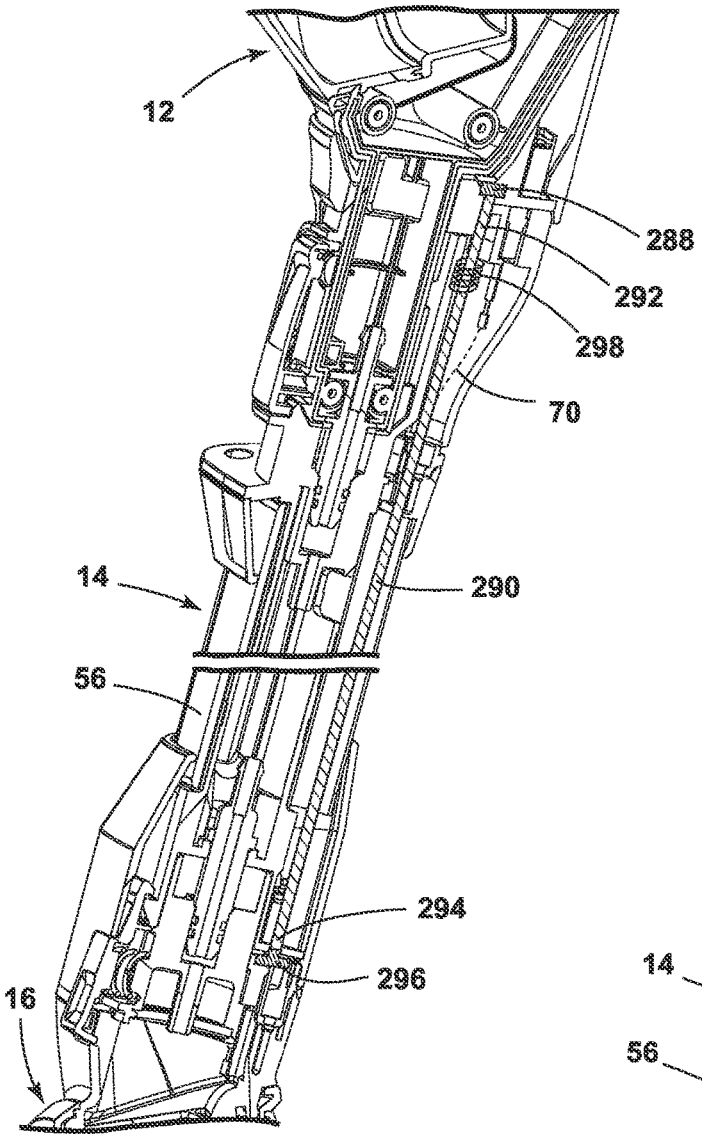
FIG. 33 is a partial sectional view through the wand with the steam sweeper in the upright or mopping mode of operation shown in FIG. 31, with a push rod closing the switch to provide power to the wand.

FIG. 30 is a cross-sectional view through the distal end 60 of the wand 14, with the scrubbing brush 272 in the second position. In the second position, the bristles 276 can project beyond the distal end 60 of the wand 14 to agitate and scrub a surface. Steam is distributed through the wand nozzle 62 and passes through an opening 284 at the center of the scrubbing brush 272 onto the surface to be cleaned for focused steam delivery.

The scrubbing brush 272 can comprise a shutter 286 for covering the electrical connector 74 in the second position. The shutter 286 can be carried on, formed with, or otherwise joined to the body 274. Optionally, the shutter 286 can seal an opening to the electrical connector 74 and serves to block steam, liquid, or dirt from reaching the electrical connector 74.

Figure 29:
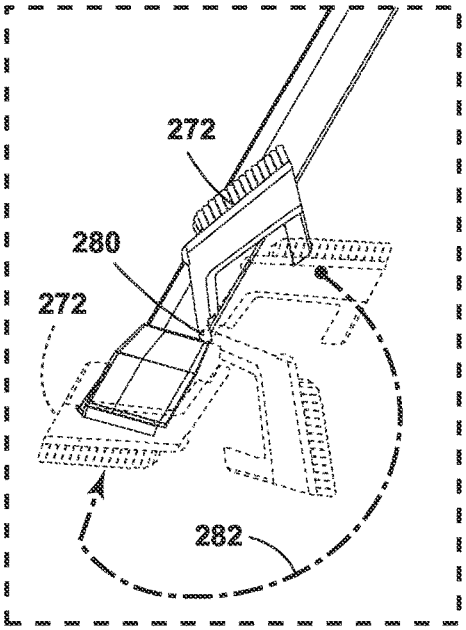
FIG. 29 is an enlarged view of a distal end of a wand of the surface cleaning apparatus of FIG. 27, showing a scrubbing brush moving between a first stored position and a second scrubbing position.

As shown in FIG. 27, when the base 16 is coupled with the wand 14, the scrubbing brush 272 is inaccessible for use and pivoted to the first position, When the body 274 is fully pivoted toward the wand housing 56 in the first position, the body 274 is lies against a back side of the wand housing 56, thereby exposing the electrical connector 74. Separation of the wand 14 from the base 16, as shown in FIG. 28, exposes the scrubbing brush 272, and the scrubbing brush 272 can be rotated downwardly and pushed upwardly into place on the end of the wand 14 as shown in FIG. 29.

FIGS. 31-34 show yet another embodiment of the steam sweeper 10 where the wand 14 includes the scrubbing brush 272. In this embodiment, the transmission of power and/or data signals to the wand 14 is turned off when the base 16 is disconnected from the wand 14. For example, disconnection of the base 16 can cut off electrical power to the wand conductor 70.

Optionally, the power may be turned on and off by a mechanical switch 288, such as a micro-switch, in the steam unit 12 which is actuated by a push rod 290 in the wand 14. Power supply to the wand 14 is turned on by the connection of the base 16 to the wand 14, which forces the push rod 290 to travel a predetermined distance along its longitudinal axis to actuate the switch 288. Removal of the base 16 allows the push rod 290 to travel a predetermined distance back away from the switch 288, which opens the electrical circuit between the wand 14 and base 16.

The push rod 290 can be primarily positioned within the wand 14, such as within the wand housing 56, and slidable along the wand 14. The push rod 290 has a first or proximal end 292 in register with the switch 288 and a second or distal end 294 register with a pressing portion 296 on the base 16 for axial displacement of the push rod 290. The push rod 290 is biased away from the switch 288 by a biasing element 298, such as a spring or flexible arm.

When the base 16 is attached to the wand 14, the pressing portion 296 is brought into contact with and bears against the distal end 294 of the push rod 290. This forces the proximal end 292 of the push rod 290 to slide with the wand housing 56 and engage the switch 288 to turn on the supply of power to the wand 14, and therefore to the base 16. Separation of the base 16 from the wand 14 removes the pressing portion 296 from engagement with the push rod 290, and the push rod 290 slides distally relative to the wand housing 56 under the urging of the biasing element 298. The proximal end 292 slides away from the switch 288, and the switch 288 opens to cut off power transmission to the wand conductor 70.

Figure 35:
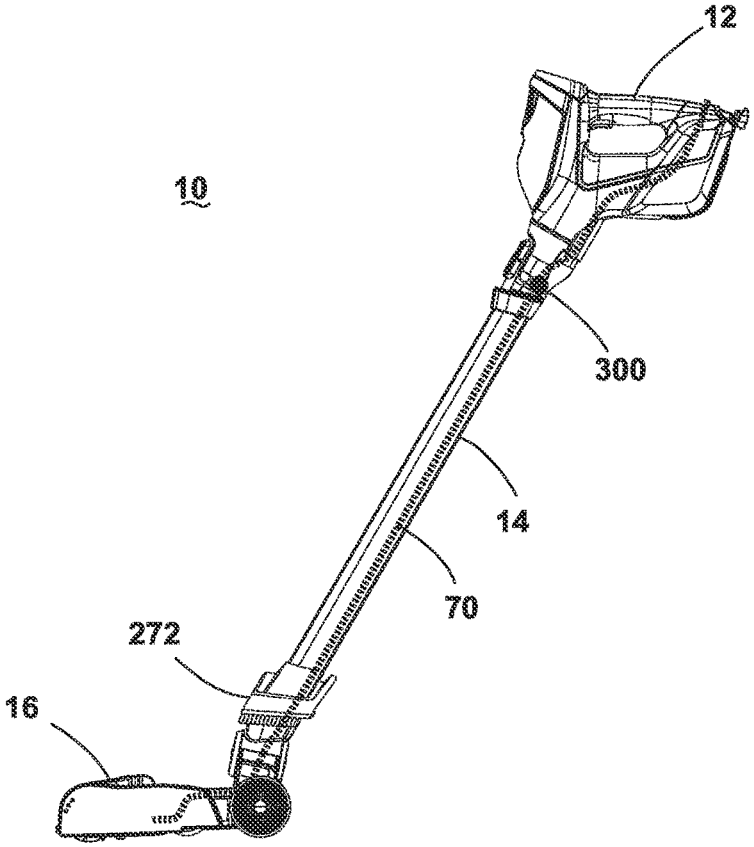
FIG. 35 is a perspective view of a surface cleaning apparatus in the form of a convertible steam sweeper according to a further embodiment of the invention, with the steam sweeper in an upright or mopping mode of operation and where power to the wand and base is turned on by a relay.
Figure 36:
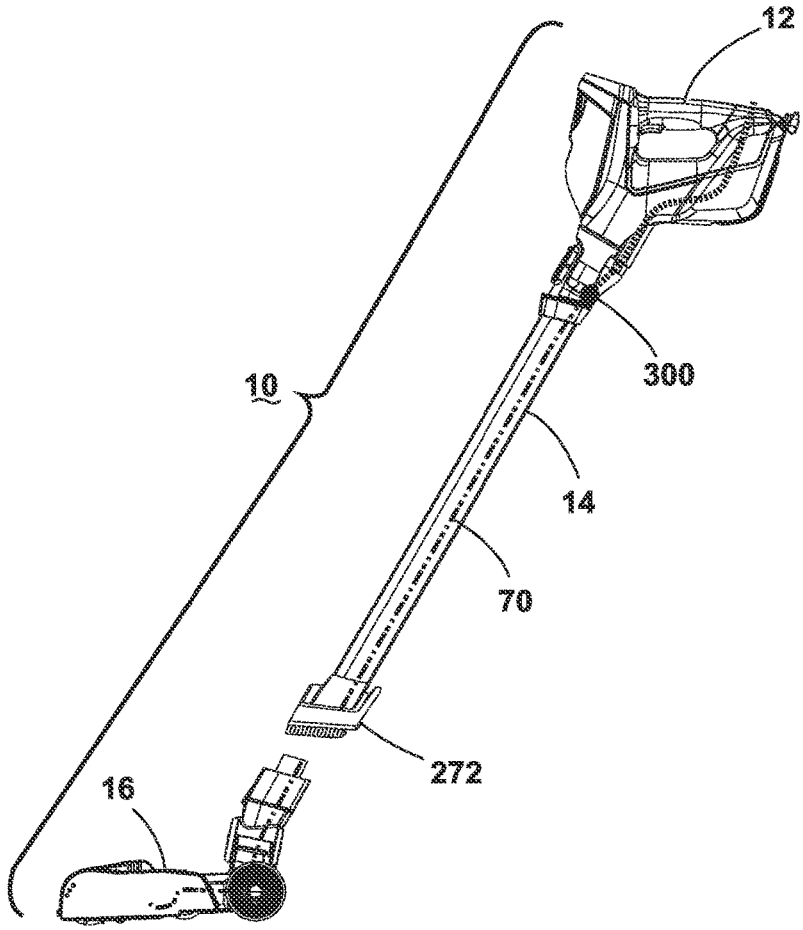
FIG. 36 is a perspective view of the surface cleaning apparatus of FIG. 35 in a remote cleaning mode of operation or scrubbing mode, and where power to the wand and base is turned off by the relay.
Figure 37:
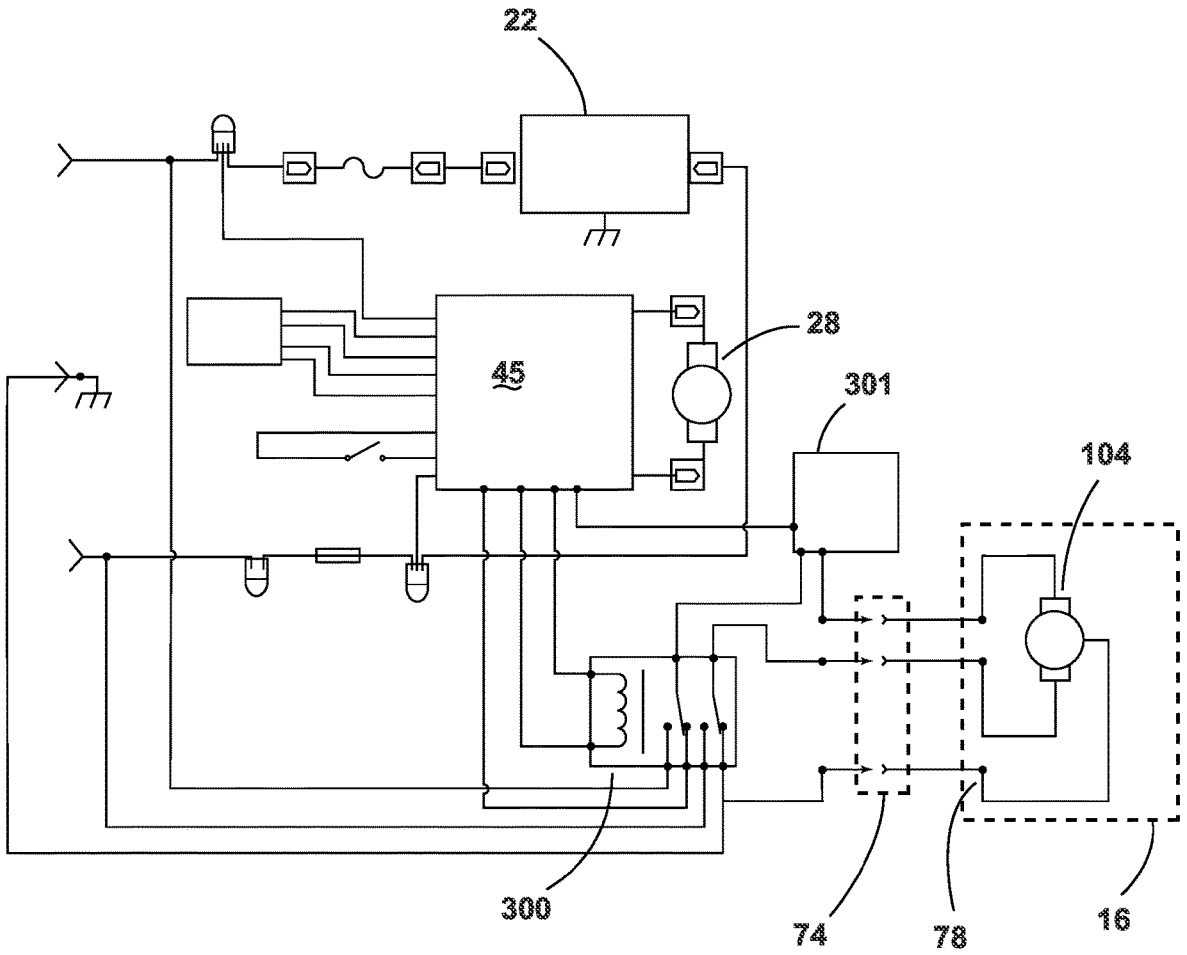
FIG. 37 is a schematic circuit diagram for the surface leaning apparatus of FIG. 35.

FIGS. 35-37 shows still another embodiment of the steam sweeper 10 where the wand 14 includes the scrubbing brush 272 and where electrical power and/or data to the wand 14 is turned off when the base 16 is disconnected from the wand 14. In one example, a relay 300 can open to cut off the transmission of power and/or data signals to the wand conductor 70 when the base 16 is disconnected from the wand 14. The relay 300 can close upon connection of the base 16 to the wand 14.

In this embodiment, power is turned off by a relay 300 in the steam unit 12 that opens when the electrical circuit between the wand 14 and base 16 is opened, i.e. when the base 16 is disconnected from the wand 14. Attaching the base 16 to the wand 14 closes the relay 300, which completes the electrical circuit and energizes electrical components in the base 16.

FIG. 37 is a schematic circuit diagram for the steam sweeper 10 of FIGS. 35-36. The relay 300, which can optionally be a double pole double throw (DPDT) relay, can be electronically coupled with a motor current sensor circuit 301 which senses motor current of the brush motor 104 in the base 16 and provides input to the controller 45. The controller 45 will open the relay 300 when the sensor circuit 301 does not detect any motor current from the brush motor 104, i.e. when the base 16 is disconnected from the wand 14. The motor current sensor circuit 301 can also be used to detect when the brush motor 104 is locked or jammed due to the brushroll 92 (or drivetrain) becoming jammed or obstructed, thereby preventing rotation. The controller 45 will open the relay 300 when the motor current is too high, i.e. when the brush motor 104 is locked, and turn off power supply to the base 16 even when attached to the wand 14.

Figure 34:
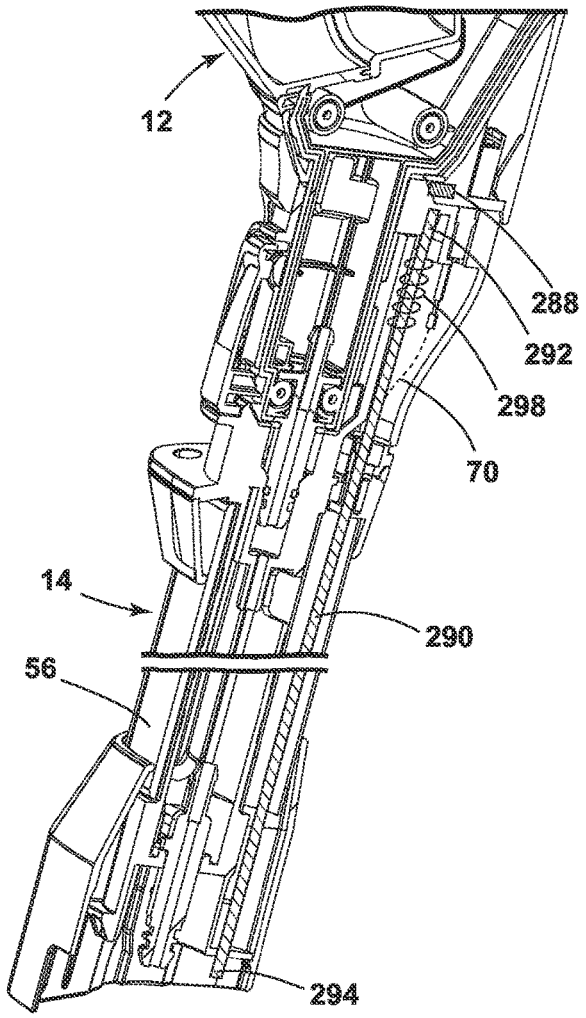
FIG. 34 is a partial sectional view through the wand with the steam sweeper in the remote cleaning mode of operation or scrubbing mode shown in FIG. 32, with the switch open to turn off power to the wand.
Figure 38:
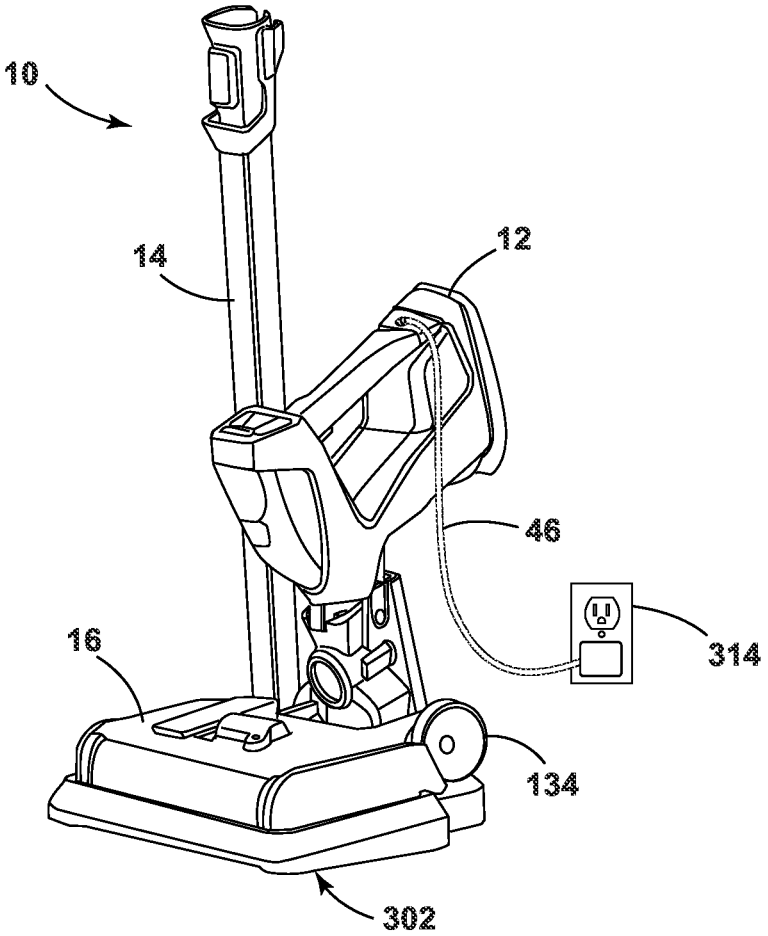
FIG. 38 is a perspective view of a surface cleaning apparatus docked with a cleaning tray according to one embodiment of the invention.
Figure 39:
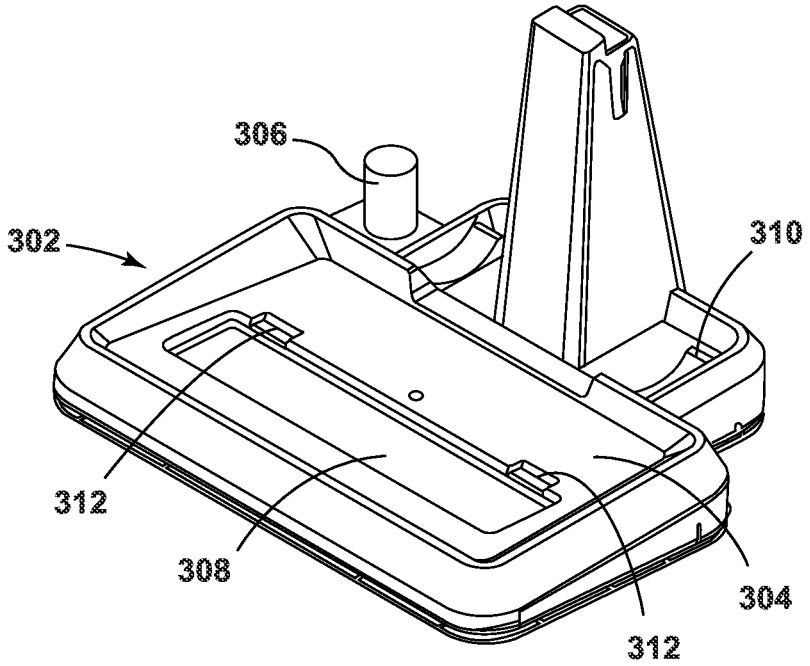
FIG. 39 is a perspective view of the cleaning tray from FIG. 38.

FIGS. 38-39 show one embodiment of a tray 302 in which the steam sweeper 10 can be docked or stored. The tray 302 is configured to support the components of the steam sweeper 10 thereon, optionally in a fully assembled or partially disassembled state as shown in FIG. 34, where the wand 14 is stored separated from the assembled steam unit 12 and base 16.

As described in further detail below, the tray 302 can also be used during a self-cleaning or sanitization process. During use, the steam sweeper 10 may get very dirty, particularly in the base 16, and can be difficult for the user to clean. A self-cleaning system and method using the tray 302 may be provided for the steam sweeper 10, which saves the user considerable time and may lead to more frequent use of the steam sweeper 10.

The tray 302 includes a base receiver 304 for physically supporting the base 16 and a wand receiver 306 for physically supporting the wand 14 in an upstanding positon. The steam unit 12 can be stored via attachment to the base 16. The base receiver 304 can comprise a collection reservoir 308 which collects fluid and dirt either falls off during storage after a cleaning operation or that is rinsed out during self-cleaning. The reservoir 308 is in register with the base opening 122 and brushroll 92. A rear portion of the tray 302 can comprise wheel wells 310 for receiving the rear wheels 134 of the base 16. A middle portion of the tray 302 can comprise wheel wells 312 for receiving the front wheels 132 of the base 16.

Figure 40:
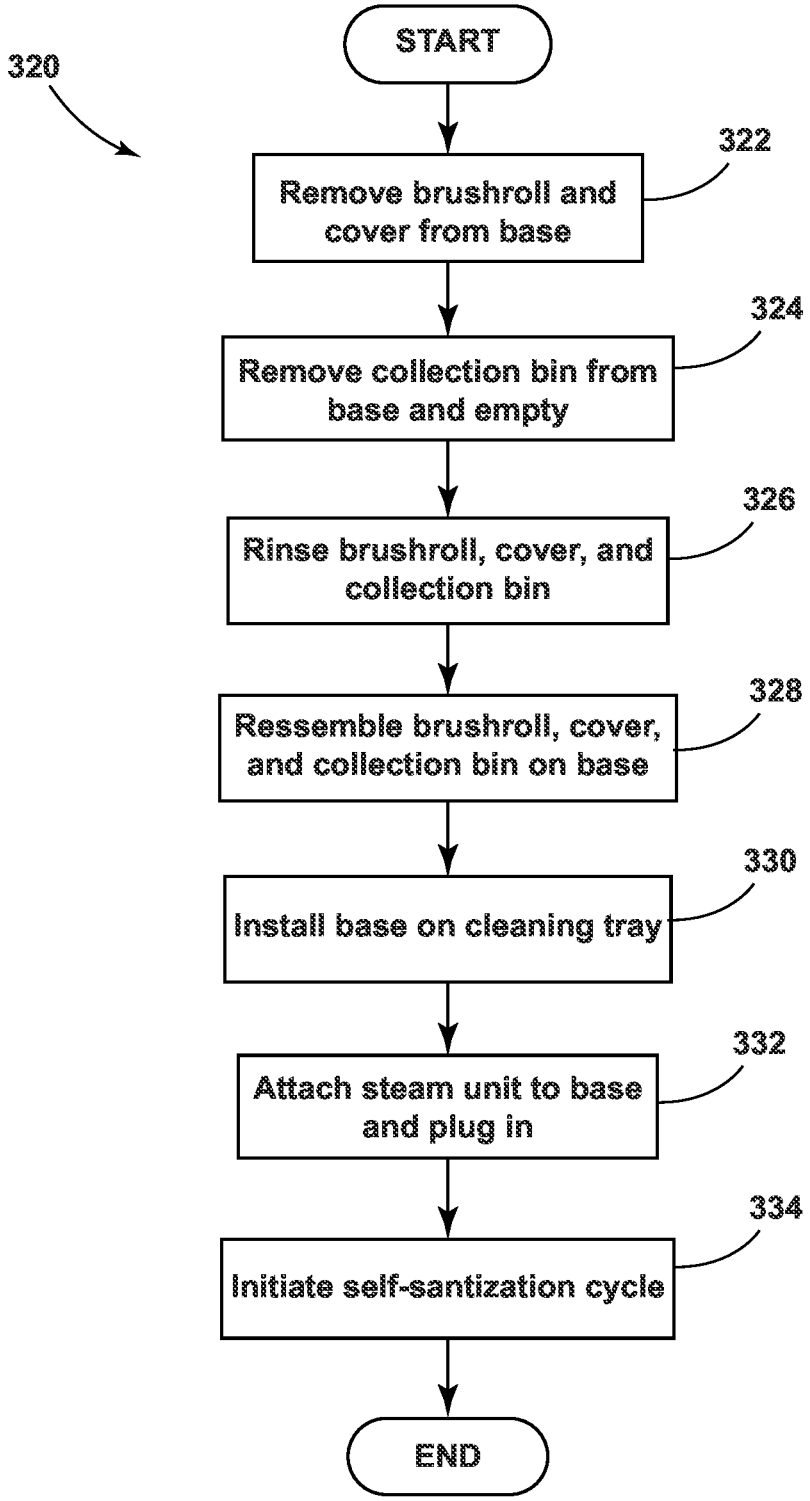
FIG. 40 is a flow chart showing one embodiment of a method for cleaning and sanitizing a surface cleaning apparatus
Figure 41:
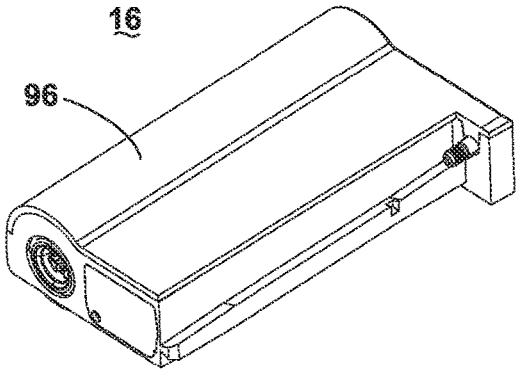
FIG. 41 is a rear perspective view of yet another embodiment of a base of the surface cleaning apparatus.

FIG. 40 is a flow chart showing one embodiment of a method 320 for cleaning and sanitizing the steam sweeper 10. As used herein, the term "sanitize" and variations thereof refers to the reduction of bacteria and mold on a surface defining the steam supply pathway of the steam sweeper 10 by a significant number. An at least 99%, and alternatively an at least 99.9%, reduction of the inoculated bacteria and mold on a surface of the steam sweeper 10 defining the steam supply pathway is considered significant. The sequence of steps discussed is for illustrative purposes only and is not meant to limit the method 320 in any way as it is understood that the steps may proceed in a different logical order, additional or intervening steps may be included, or described steps may be divided into multiple steps, without detracting from the invention.

First, the base 16 is cleaned. At step 322, a user removes the brushroll 92 from the base. Depending on the embodiment of the steam sweeper 10, this may also include removing the cover 96 from the base 16.

At step 324, the user removes the collection bin 94 from the base 16 and empties any collected dirt or liquid in a suitable waste receptacle, such as a trash can, sink, or toilet.

At step 326, the brushroll 92 and collection bin 94 are rinsed off to clean any accumulated dirt, optionally with water or with a mixture of water and a cleaning agent, such as soap. If necessary, the user may scrub portions of the brushroll 92 or collection bin 94 to clean off stubborn dirt. The cover 96, if present, may be similarly rinsed at step 326.

At step 328, the brushroll 92, cover 96 (if present), and collection bin 94 are reinstalled on the base 16. Optionally, a user may manually dry or air-dry the components completely or partially before reassembling the base 16.

Next, the user at docks the steam sweeper 10 with the cleaning tray 302. At step 330, the docking may include installing or parking the base 16 on the tray 302. Optionally, the wand 14 can be inserted into the wand receiver 306 of the tray 302.

At step 332, the steam unit 12 is attached to the base 16, as shown in FIG. 38 and the power cord 46 is plugged in to source of power, such as an A/C power outlet 314. If necessary, the supply tank 24 is filled with clean water, prior to or after attachment of the steam unit 12 to the base 16.

At step 334, the user initiates a self-sanitization cycle of the steam sweeper 10. The user may have to wait for a pre-heating cycle to complete after plugging in the power cord 46 and before initiating the self-sanitization cycle. During the pre-heating cycle, the steam generator 22 is activated without activation of the pump 28 for a predetermined period of time to allow the steam generator 22 to warm up sufficiently to generate steam. The predetermined period of time can be, for example, 30 seconds. The user interface 47 can provide a first notification indicating when the steam sweeper 10 is pre-heating, and can provide a second notification indicating when the steam generator 22 is ready to generate steam.

During the self-sanitization cycle, steam is distributed from the steam unit 12 through the base 16. Components such as the brushroll 92, cover 96, and brush chamber 124, and optionally other components of the steam delivery system, are exposed to steam and sanitized to reduce the bacteria and/or thereon by a significant number, such as by at least 99%, and alternatively by at least 99.9%.

Initiation of the self-sanitization cycle may comprise providing an input control via the user interface 47 and/or actuator 30 of the steam unit 12. The self-sanitization cycle can be manual, with the user initiating the cycle by depressing the actuator 30 on the steam unit 12 to distribute steam through the base 16. The user can depress the actuator 30 for a predetermined period of time, such as 1 minute, in order to fully sanitize the components of the steam delivery system. Alternatively, the self-sanitization cycle can be automated so that the cycle is controlled by the controller 45 on the steam unit 12. In the latter case, a user-engageable button or switch on the user interface 47 may be pressed by the user to initiate the automated self-sanitization cycle.

During the self-sanitization cycle, the brushroll 92 can rotate to expose all sides of the brushroll 92 to the steam distributor 90. Rotation of the brushroll 92 can also mechanically propel liquid and dirt in the collection bin 94.

After sanitization, the method 320 can end. The user can, for example release the actuator 30 and unplug the steam unit 12.

FIGS. 41-45 show yet another embodiment of the base 16 for the steam sweeper 10, wherein the base 16 includes a mechanical cleanout mechanism to empty debris and liquid from the collection bin 94 and wipe off at least one internal surface 342 of the base 16. The base 16 can be fitted with a cleanout member 344 for cleaning the internal surface 342. The cleanout member 344 is moveable to push, pull or otherwise force debris and liquid toward, out of, or through a debris opening in the base 16. The movement of the cleanout member 344 drives a wiper or brush to mechanically remove the debris accumulated on the internal surface 342, i.e. an interior or inwardly facing surface of the base 16, that may otherwise be trapped within the base 16. The cleanout member 344 shown herein is manually operated, but in other embodiments the cleanout member 344 may be moved by the action of a motor for automatic operation. While not shown or described in detail for FIGS. 41-45, the base 16 can comprise the steam distributor 90, brush motor 104, coupler 82, relief vent 158, steam vent 210, and other features as described for the base 16 any of the previous embodiments.

Figure 42:
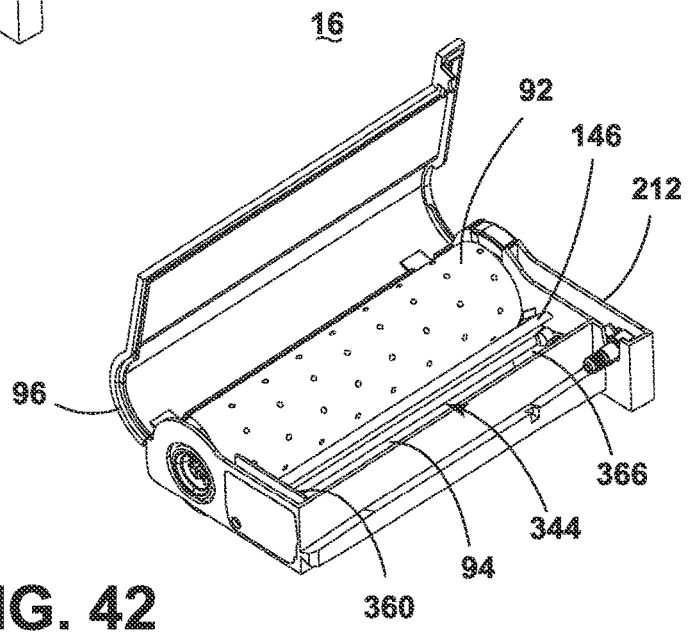
FIG. 42 is a view of the base from FIG. 41, illustrating a cover of the base in an open position to show a mechanical cleanout mechanism comprising a cleanout member.
Figure 43:
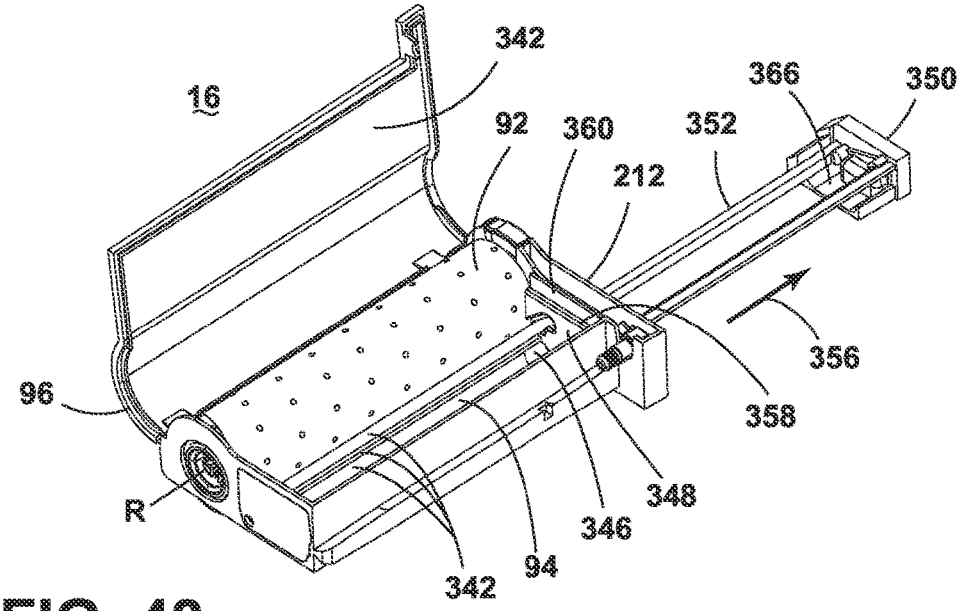
FIG. 43 is a view of the base from FIG. 41, showing the actuation of a mechanical cleanout mechanism to empty debris from a collection bin and wipe internal surfaces of the base.
Figure 44:
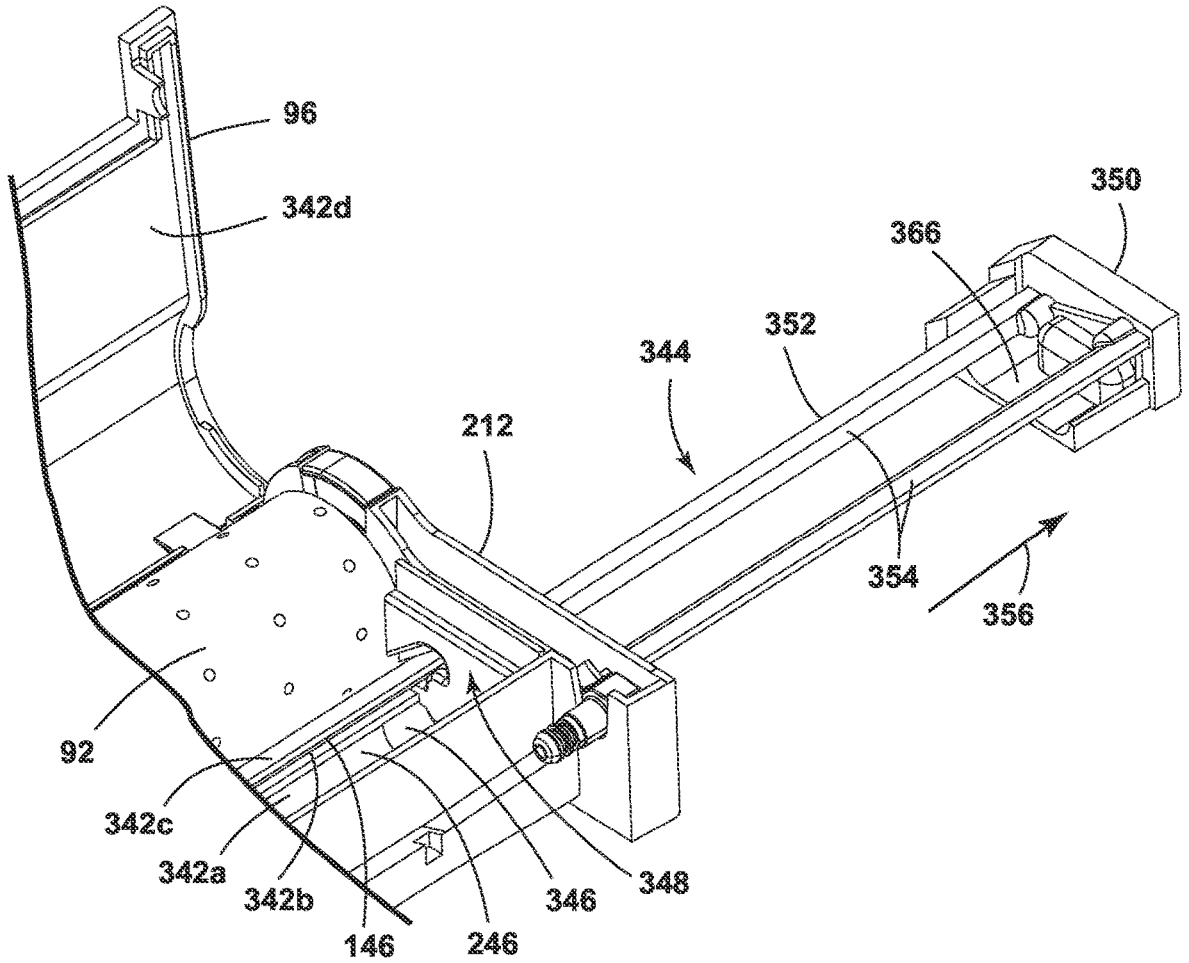
FIG. 44 is a close up view of a portion of FIG. 43, showing details of the cleanout member.
Figure 45:
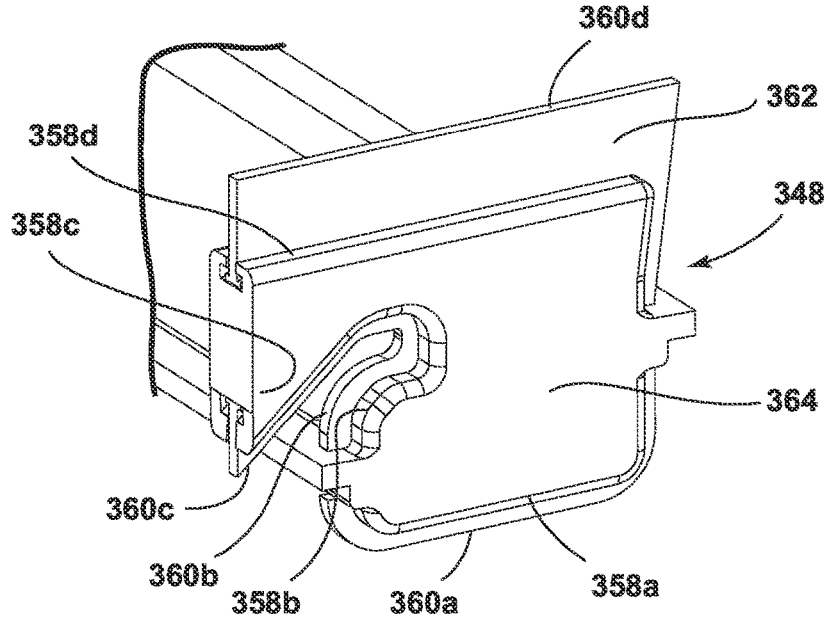
FIG. 45 is a perspective view showing a wiper of the cleanout member.
Figure 46:
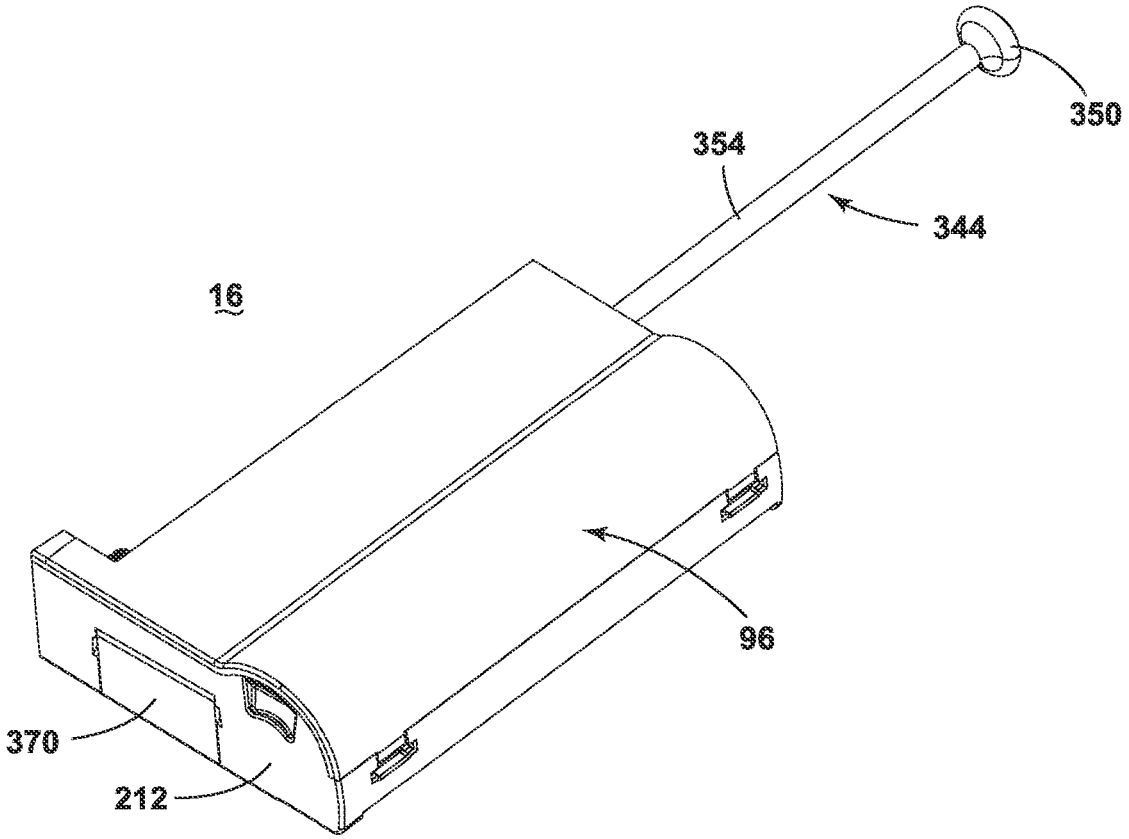
FIG. 46 is a rear perspective view of still another embodiment of a base of the surface cleaning apparatus.
Figure 49:
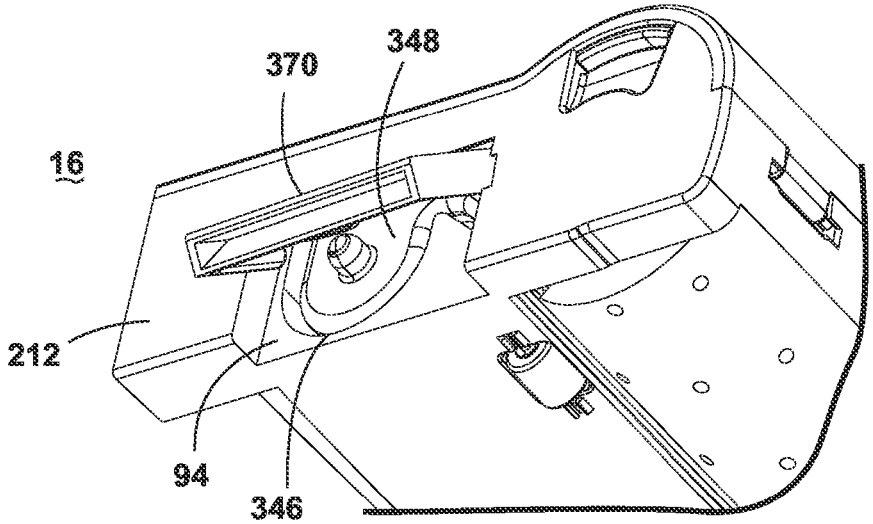
FIG. 49 is a close up view of the base from FIG. 46, showing the cleanout member pushing a cleanout door to an open position.

The cleanout member 344 can be moved along an axis in a direction indicated by arrow 356 between a first position shown in FIG. 42 and a second or cleanout position shown in FIG. 43. This axis can be parallel to the rotation axis R of the brushroll 92. In the embodiment shown, the cleanout member 344 is pulled out from the base 16 to mechanically wipe debris from the internal surface 342 of the base 16, and eject the debris and liquid from the base 16 through a debris outlet 346 into a suitable waste receptacle, such as a trash can, sink, or toilet. The collection bin 94 is thereby emptied without being removed from the base 16. The collection bin 94 can still be removable from the base 16, as described for the previous embodiments, for a more throughout cleaning, or may be non-removable from the base 16. It is noted that the cover 96 is shown in an open position in FIGS. 42-44 to show the details of the cleanout member 344, but that in operation the cover 96 may remain closed on the base 16 when the cleanout member 344 is used so that the internal surface 342*d* can be wiped clean.

The cleanout member 344 can comprise a wiper 348 configured to interface with one or more internal surfaces 342 of the base 16. While one wiper 348 is shown, in an alternative embodiment, multiple wipers can be provided, and interface with different portions of the base 16. The wiper 348 can help remove dirt from the base 16 by scraping or otherwise moving debris toward the debris outlet 346. The wiper 348 can also move liquid toward the debris outlet 346.

The cleanout member 344 can comprise a handle 350 and a link 352 coupling the handle 350 to the wiper 348 for movement of the wiper 348 as the handle 350 is moved. The link 352 can comprise at least one rod 354 or other rigid connector coupling the wiper 348 with the handle 350. A non-rigid coupling or connector can alternatively be used. As yet another alternative, a multiple-member link 352 can be used. In the embodiment shown, multiple rods 354 extend through the collection chamber 152 when the cleanout member 344 is in the first position shown in FIG. 42.

The internal surfaces of the base 16 wiped by the wiper 348 can, for example, comprise one or more of a first internal surface 342*a* of the collection bin 94, a second internal surface 342*b* of the collection bin 94, an internal surface 342*c* of the ramp 146, or an internal surface 342*d* of the cover 96. During operation of the steam sweeper 10, these surfaces are open or exposed to collected dirt and liquid, and can be difficult to access for cleaning. In the embodiment, shown, where the collection bin 94 is integral with and non-removal from the base 16, the ramp 146 can meet the collection bin 94 at the transition between the internal surfaces 342*b*, 342*c*.

The wiper 348 can include at least at least one edge 358 that interfaces with an internal surface of the base 16. The edge 358 can be in close contact with the surface 342, or spaced away from the surface 342 but still sufficiently close to wipe debris therefrom. In the embodiment shown, the wiper 348 has a first edge 358*a* that scraps or interfaces with the first collection bin surface 342*a*, a second edge 358*b* that scrapes or interfaces with the second collection bin surface 342*b*, a third edge 358*c* that scrapes or interfaces with the ramp surface 342*c*, and a fourth edge 358*d* that scrapes or interfaces with the cover internal surface 342*d*.

Any one or more of the edges 358 can comprise a brush 360 that sweeps away dirt, hair, and other debris from the internal surface of the base 16. The brush 360 can also help wipe or move liquid toward the debris outlet 346. The brush 360 can comprise a wiping medium 362, such as a plurality of bristles extending from a body 364 of the wiper 348. The bristles 362 can be arranged in a plurality of tufts or in a unitary strip, and can be constructed of nylon, or any other suitable synthetic or natural fiber. The wiper body 364 which supports the bristles 362 can be substantially rigid or inflexible in comparison to the bristles 362.

In other embodiments, instead of bristles, the wiper edges 358 can comprise another wiping medium 362, such as fabric, rubber, foam, or other wiping medium suitable for mechanically wiping internal surfaces of the base 16. As other alternatives, a squeegee or a rake can be provided on one or more of the wiper edges 358.

In the embodiment shown, the wiper 348 has a first brush 360*a* on the first edge 358*a*, a second brush 360*b* on the second edge 358*b*, a third brush 360*c* on the third edge 358*c*, and a fourth brush 360*d* on the fourth edge 358*d*. The first brush 360*a* sweeps away dirt, hair, and other debris from the first collection bin surface 342*a*. The second brush 360*b* sweeps away dirt, hair, and other debris from the second collection bin surface 342*b*. The third brush 360*c* sweeps away dirt, hair, and other debris from the ramp surface 342*c*. The fourth brush 360*d* sweeps away dirt, hair, and other debris from the cover internal surface 342*d*.

The edges 358 and/or brushes 360 can generally conform to the contour of the internal surface 342 which they wipe and/or sweep to thoroughly clean the internal surface 342. In the embodiment shown, the first edge 358*a* and first brush 360*a* are flat or straight, with curved outer portions, to conform to the contour of the first internal surface 342*a* of the collection bin 94. The second edge 358*b* and second brush 360*b* are curved and convex to conform to the contour of the second internal surface 342*b* of the collection bin 94, including the top edge that transitions to the ramp 146. The third edge 358*c* and third brush 360*c* are angled to conform to the contour of the internal surface 342*c* of the ramp 146. The fourth edge 358*d* and fourth brush 360*d* are flat or straight to conform to the contour of the internal surface 342*d* of the cover 96.

Optionally, the cleanout member 344 can be moved through one or the lateral sides 212 of the base 16. The cleanout member 344 can slide out of a housing of the base 16 transversely to empty debris and liquid from the collection bin 94 and wipe off at least one internal surface 342 of the base 16. The brushes 360 translate laterally across the internal surfaces 342 to sweep away dirt, hair, and other debris. In the embodiment illustrated herein with the handle 350 and rods 354, the base 16 can comprise suitable openings at one lateral side 212 through which the rods 354 can transversely slide. The lateral side 212 can optionally comprise a pocket in which the handle 350 is recessed when in the first position shown in FIG. 42.

The debris outlet 346 can be provided in the collection bin 94, so that debris and liquid in the collection bin 94 can be emptied through the outlet 346 without removal of the bin from the base. The debris outlet 346 can be, for example, provided in the bottom wall 246 of the bin. Debris and liquid drops out through the debris outlet 346, which can be opened when the cleanout member 344 is pulled out, for example to the cleanout position shown in FIG. 43. In one embodiment, the debris outlet 346 can be provided near one of the lateral sides 212 of the base 16 so that one pull stroke of the cleanout member 344 can empty out the bin 94 and move the wiper 348 substantially the entire length of the bin 94 to clean the internal surfaces 342.

The cleanout member 344 can comprise a cover 366 for the debris outlet 346 and which is configured to close the debris outlet 346 when the cleanout member 344 is pushed in to the position shown in FIG. 42. The cover 366 can, for example, be joined with or otherwise provided on the handle 350, such that moving the handle 350 separates the cover 366 from the debris outlet 346. The cover 366 can also be provided on another portion of the cleanout member 344, such as on the linkage 352.

When the handle 350 is pulled out, the wiper 348 slides under the pulling force of the linkage 352 and effects a wiping action on the internal surfaces 342 of the base 16. At the end of the pull, i.e. when the wiper 348 reaches the position shown in FIG. 43, debris and liquid can drop out of the base 16 through the debris outlet 346. With the mechanical cleanout mechanism, it is possible to can clean internal, hard-to-reach portions of the base 16 that are typically difficult to access. Cleanout is performed quickly, without having to open or touch any dirty portions of the base directly.

FIGS. 46-49 show still another embodiment of the base 16 for the steam sweeper 10, wherein the base 16 includes a mechanical cleanout mechanism to empty debris and liquid from the collection bin 94 and wipe off at least one internal surface 342 of the base 16. The cleanout mechanism can be substantially similar to the cleanout mechanism described above with respect to FIGS. 41-45, with the following exceptions. Instead of pulling the wiper 348, the cleanout mechanism 344 pushes the wiper 348 to mechanically remove the debris accumulated on the internal surfaces 342. The cleanout member 344 shown herein is manually operated, but in other embodiments the cleanout member 344 may be moved by the action of a motor for automatic operation. While not shown or described in detail for FIGS. 46-49, the base 16 can comprise the steam distributor 90, brush motor 104, coupler 82, relief vent 158, steam vent 210, and other features as described for the base 16 any of the previous embodiments.

Figure 47:
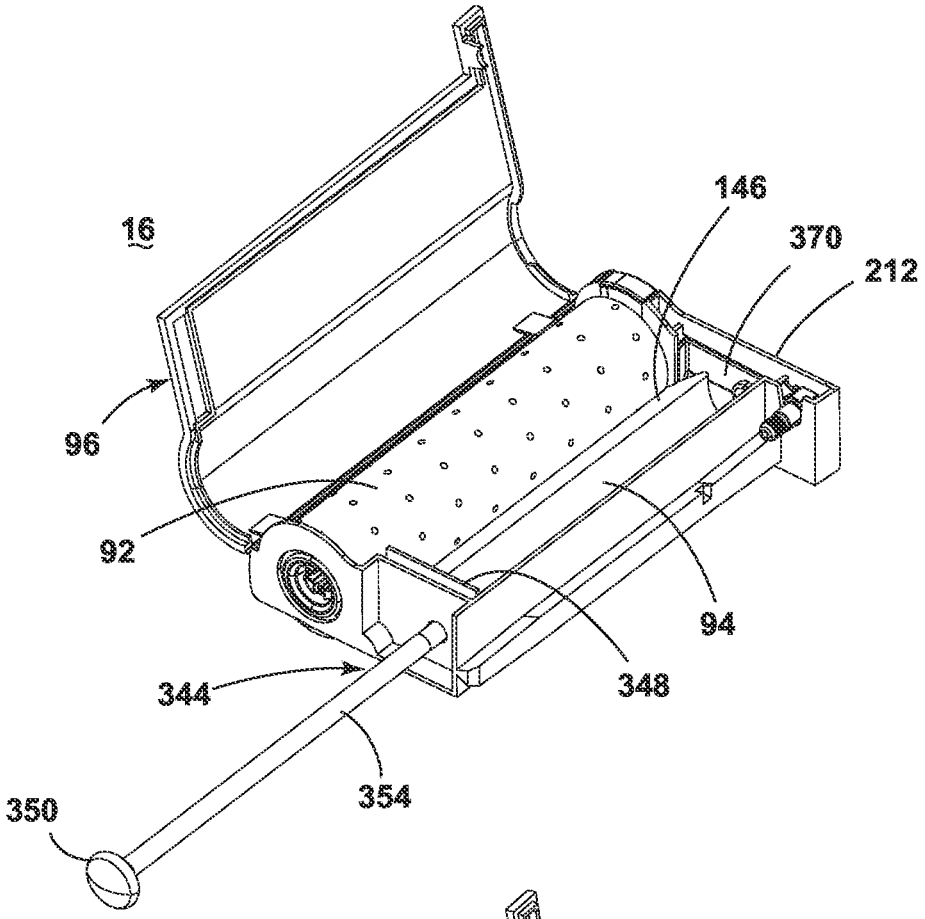
FIG. 47 is a view of the base from FIG. 46, illustrating a cover of the base in an open position to show a mechanical cleanout mechanism comprising a cleanout member.
Figure 48:
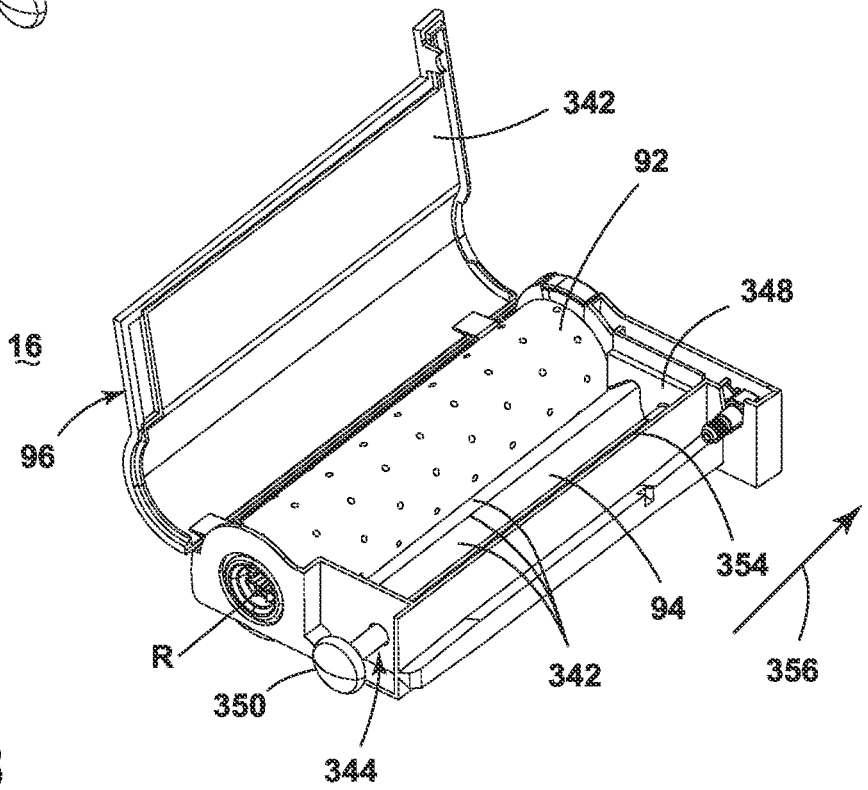
FIG. 48 is a view of the base from FIG. 46, showing the actuation of a mechanical cleanout mechanism to empty debris from a collection bin and wipe internal surfaces of the base.

The cleanout member 344 can be moved along an axis in the direction indicated by arrow 356 between a first position shown in FIG. 47 and a second or cleanout position shown in FIG. 48. In the embodiment shown, the cleanout member 344 is pushed into the base 16 to mechanically wipe debris from the internal surface 342 of the base 16, and eject the debris and liquid from the base 16 through a debris outlet into a suitable waste receptacle, such as a trash can, sink, or toilet. It is noted that the cover 96 is shown in an open position in FIGS. 47-48 to show the details of the cleanout member 344, but that in operation the cover 96 may remain closed on the base 16 when the cleanout member 344 is used so that the internal surface of the cover 96 can be wiped clean.

In addition to the wiper 348, the cleanout member 344 can comprise a single rod 354 linking the handle 350 to the wiper 348. The rod 354 can be fixedly or permanently attached to the wiper 348, and thereby non-removable from the base 16. Alternatively the handle 350 and rod 354 can be a separate pusher member that is inserted through a suitable opening in the base 16 to push the wiper 348 when cleanout is desired. When not needed, the pusher member can be separated from the base 16 and stored on the steam sweeper 10 or elsewhere.

The base 16 can include a door 370 for closing the debris outlet 346 positioned at one end of the collection bin 94, with the door 370 being movable between an opened position and a closed position. When the cleanout member 344 is pushed into the second or cleanout position shown in FIGS. 48-49, the door 370 is pushed open. The door 370 can be pivotally mounted on one lateral side 212 of the base 16, and the cleanout member 344 can be pushed from the opposite lateral side of the base 16. Engagement of the wiper 438 with the inner side of the door 370, i.e. the side of the door 370 facing the interior of the collection bin 94, causes the door 370 to rotate to the open position. As a result, debris and liquid pushed by the wiper 348 can be pushed through the debris opening 346.

The debris outlet 346 of this embodiment can be provided in an end wall of the collection bin 94, so that debris and liquid in the collection bin 94 can be pushed out of the base 16 by the wiper 348 without removal of the bin from the base. The debris outlet 346 can be, for example, provided in the bottom wall 246 of the bin.

When the handle 350 is pushed in, the wiper 348 slides under the pushing force of the rod 354 and effects a wiping action on the internal surfaces 342 of the base 16. At the end of the push, i.e. when the wiper 348 reaches the position shown in FIG. 48, the wiper 348 pushes the door 370 open, and debris and liquid can drop out of the base 16 through the debris outlet 346. With the mechanical cleanout mechanism, it is possible to can clean internal, hard-to-reach portions of the base 16 that are typically difficult to access. Cleanout is performed quickly, without having to open or touch any dirty portions of the base directly.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Thus, the various features of the different embodiments may be mixed and matched in various cleaning apparatus configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. A surface cleaning apparatus for cleaning a floor surface, comprising:

a steam generator;

a supply tank in fluid communication with the steam generator;

a base adapted to move over a surface to be cleaned, the base comprising:

a base housing comprising a brush chamber;

a brushroll in the brush chamber;

a collection bin;

a steam distributor in fluid communication with the steam generator and configured to dispense steam into the brush chamber; and at least one steam vent in the base housing to vent a portion of the steam dispensed by the steam distributor from the brush chamber.

2. The surface cleaning apparatus of claim 1, wherein the at least one steam vent comprises a plurality of openings in the base housing.

3. The surface cleaning apparatus of claim 1, wherein the base housing comprises a first lateral side and a second lateral side, and wherein the at least one steam vent is provided in the first lateral side of the base housing.

4. The surface cleaning apparatus of claim 3, wherein the at least one steam vent vents steam laterally from the base.

5. The surface cleaning apparatus of claim 3 comprising a removable cover for the brush chamber, and the at least one steam vent comprises first openings in the cover and second openings in the first lateral side of the base housing, wherein the first and second openings are at least partially aligned to provide a passage from the brush chamber to an exterior of the base.

6. The surface cleaning apparatus of claim 1, wherein the base housing comprises a first lateral side and a second lateral side, and wherein the at least one steam vent comprises a first steam vent provided in the first lateral side and a second steam vent provided in the second lateral side.

7. The surface cleaning apparatus of claim 6, wherein the first and second steam vents are provided at opposing ends of the brush chamber.

8. The surface cleaning apparatus of claim 1, wherein the steam distributor is positioned to dispense steam onto the brushroll.

9. The surface cleaning apparatus of claim 1, wherein the steam distributor comprises a steam manifold having a transversely-elongated steam path with a plurality of openings spaced along its length, the steam manifold delivering steam to the brush chamber through the openings.

10. The surface cleaning apparatus of claim 1, wherein the brushroll is rotatable within the brush chamber, and wherein rotation of the brushroll positively pressurizes the brush chamber, and the base comprises at least one relief vent in the base housing configured to relieve positive pressure in the brush chamber.

11. The surface cleaning apparatus of claim 10, wherein the at least one relief vent provides a passage for air from the collection bin to an exterior of the base.

12. The surface cleaning apparatus of claim 10, wherein the base comprises a front wiper with a front interference edge extending rearwardly to face the brush chamber and interface with the brushroll.

13. The surface cleaning apparatus of claim 1, wherein the brushroll comprises a hybrid brushroll having a first sweeping medium comprising a plurality of bristles and a second sweeping medium comprising microfiber material.

14. The surface cleaning apparatus of claim 1, wherein the base comprises a front wiper with a front interference edge extending rearwardly to face the brush chamber and interface with the brushroll, and a rear wiper with a rear interference edge extending at least one of downwardly and forwardly to face the brush chamber and interface with the brushroll.

15. The surface cleaning apparatus of claim 1 comprising:

a steam unit, wherein the steam generator is provided in the steam unit housing; and an elongated wand coupled with an outlet of the steam unit and with the base.

16. The surface cleaning apparatus of claim 15, wherein the surface cleaning apparatus is convertible to at least one of:

a handheld mode, where the wand is detachable from the steam unit to convert the surface cleaning apparatus to the handheld mode;

a remote cleaning mode, where the wand is detachable from the base to covert the surface cleaning apparatus to the remote cleaning mode; and a handheld accessory mode, where the wand is detachable from the steam unit and the base, and the base is coupleable with the outlet of the steam unit to covert the surface cleaning apparatus to the handheld accessory mode.

17. The surface cleaning apparatus of claim 15 comprising a swivel joint coupling the base to the wand for movement about at least a first axis of rotation and a second axis of rotation that is orthogonal to the first axis of rotation.

18. The surface cleaning apparatus of claim 1, wherein the base comprises a pocket receiving the collection bin, the pocket having an open end at a lateral side of the base housing, wherein the collection bin is slidable out of the pocket through the lateral side of the base housing to remove the collection bin from the base housing.

19. The surface cleaning apparatus of claim 1 comprising an integrated bin/brushroll module including the brushroll and the collection bin, wherein the brushroll and the collection bin are removable from the base housing together in one action via removal of the integrated bin/brushroll module from the base housing.

20. A surface cleaning apparatus for cleaning a floor surface, comprising:

a steam unit comprising a steam unit housing, a steam generator provided in the steam unit housing, and a supply tank in fluid communication with the steam generator;

an elongated wand coupled with an outlet of the steam unit;

a base coupled with the wand and adapted to move over a surface to be cleaned, the base comprising:

a base housing comprising a brush chamber;

a brushroll mounted on the base housing in the brush chamber and adapted to contact the surface to be cleaned to sweep dirt and liquid;

a collection bin mounted on the base housing in a location to receive dirt and liquid swept by the brushroll;

a steam distributor in fluid communication with the steam generator via the wand and configured to dispense steam into the brush chamber; and at least one steam vent in the base housing to vent a portion of the steam dispensed by the steam distributor from the brush chamber.

* * * * *